US009775424B2

(12) United States Patent
Erickson et al.

(10) Patent No.: US 9,775,424 B2
(45) **Date of Patent: *Oct. 3, 2017**

(54) APPLICATOR HAVING A LID USABLE AS A HANDLE

(71) Applicant: AptarGroup, Inc., Crystal Lake, IL (US)

(72) Inventors: Gregory Alan Erickson, Wheaton, IL (US); Mark G. Neuhalfen, Mount Prospect, IL (US); Stephen Virgilio, Mount Prospect, IL (US)

( * ) Notice: Subject to any disclaimer, the term of this patent is extended or adjusted under 35 U.S.C. 154(b) by 221 days.

This patent is subject to a terminal disclaimer.

(21) Appl. No.: 14/677,458

(22) Filed: Apr. 2, 2015

(65) Prior Publication Data

US 2015/0230584 A1 Aug. 20, 2015

Related U.S. Application Data

(63) Continuation of application No. 14/371,497, filed as application No. PCT/US2014/017131 on Feb. 19, 2014, now Pat. No. 9,060,586.

(51) Int. Cl.
*A45D 40/22* (2006.01)

(52) U.S. Cl.
CPC ..... *A45D 40/22* (2013.01)

(58) Field of Classification Search
CPC .... A45D 33/025; A45D 40/221; A45D 40/22; A45D 33/006; A45D 33/04; A45D 33/06; A45D 33/16; E05D 11/06; E05D 11/08; E05D 2011/085; E05D 11/1028; E05D 11/1035; E05D 11/1078
See application file for complete search history.

(56) References Cited

U.S. PATENT DOCUMENTS 4,345,607 A * 8/1982 Contreras ..... A45C 11/24 16/227
4,372,331 A * 2/1983 Thompson ..... A45D 40/22 132/320
4,684,017 A * 8/1987 Watanabe ..... A45D 33/22 16/265
4,728,210 A 3/1988 Barish et al.
4,840,288 A * 6/1989 Lunderman ..... A45C 11/24 206/235
4,887,747 A * 12/1989 Ostrowsky ..... B65D 47/0861 16/342
5,031,647 A * 7/1991 Seidler ..... A45D 40/0087 132/317
5,038,957 A 8/1991 Gross
5,496,122 A 3/1996 Fattori
5,897,263 A 4/1999 Fattori
(Continued)

*Primary Examiner* — David Walczak
(74) *Attorney, Agent, or Firm* — Wood, Phillips, Katz, Clark & Mortimer

(57) ABSTRACT

A platform (42) and lid (44) are connected and operated by a user according to a method of applying a substance (48) to a target region. The platform (42) has an outer side (56) and has an inner side (54) defining a substance support surface (55) on which the substance (48) is supported. The user holds the open lid (44) with one hand while extending a finger of that hand alongside the platform outer side (56) and exerts a force with the finger on the platform outer side (56) in a direction to urge the substance (48) against the target region.

2 Claims, 27 Drawing Sheets

(56) References Cited

U.S. PATENT DOCUMENTS

| | | | | |
|---|---|---|---|---|
| 6,021,784 | A * | 2/2000 | Yuhara | A45C 13/005<br>132/293 |
| 8,356,952 | B2 | 1/2013 | Bennett et al. | |
| 2009/0142122 | A1 | 6/2009 | Berhault et al. | |

* cited by examiner

APPLICATOR HAVING A LID USABLE AS A HANDLE

CROSS-REFERENCE TO RELATED APPLICATIONS

This application is a continuation of U.S. patent application Ser. No. 14/371,497, filed Jul. 10, 2014, which was granted as U.S. Pat. No. 9,060,586 on Jun. 23, 2015 and which was a U.S. National Phase application based on PCT application Serial No. PCT/US2014/017131, filed Feb. 19, 2014, and each of the prior applications is incorporated herein by reference in their entirety to provide continuity of disclosure. Applicant claims the benefit of each of the prior applications.

TECHNICAL FIELD

This invention relates to packages for conveniently holding and carrying a substance, and applying it to a target region.

BACKGROUND OF THE INVENTION AND TECHNICAL PROBLEMS POSED BY THE PRIOR ART

A top (e.g., lid, closure, cap, etc.) is provided as part of some conventional packages wherein a consumer can remove the top and use the package for applying a substance (e.g., a product such as anti-perspirant, insect repellant, shoe polish, etc.) to a target region. Such a package typically consists of an applicator (including the top) and the substance (i.e., product) contained therein. With some such packages, the user may find it inconvenient or awkward to hold the package while opening or removing the top, and while discarding or retaining the top, and also while holding and moving the package to apply the substance.

Users of many such packages and applicators may have to accommodate, or contend with, a number of related or companion issues, including, but not limited to, the following:

an applicator's undesirable bulkiness, inconvenient applicator size, an applicator shape that is awkward to hold and use, insufficient capability of the applicator to prevent or minimize the ingress of dirt or other contaminants from the exterior environment into the applicator, problems of cleanliness or messiness involving the applicator, leakage of the product from the applicator, inadvertent opening of the applicator, difficulty in determining how to use the applicator, difficulty in actually using the applicator in a comfortable and efficacious manner, inconvenient manipulation of the applicator to open and/or close it and/or apply the product, difficulty in effecting a uniform application of the product to a target region, insufficient precision in controlling application of the product to a target region, difficulty in ascertaining the amount of product remaining in the applicator, difficulty in being able to apply and "use up" all or most of the product in the applicator, insufficient robustness and/or durability and/or rigidity of the applicator, susceptibility of the applicator to unintended separation or loss of one or more components of the applicator, an applicator configuration that is not aesthetically pleasing, too much applicator structure or packaging that surrounds and contains an undesirably small amount of product, insufficiently ergonomic design of the applicator, undesirably hard and/or sharp edges on portions of the applicator, discomfort while holding the applicator to apply the product, and undesirably high cost or price of the applicator.

The inventors of the present invention have discovered that it would be desirable to provide (1) an improved applicator for an applicator package containing a substance (i.e., product) that can be readily applied to a target region wherein the applicator includes a lid that also functions as a handle, (2) a set of components for being assembled as such an improved applicator, (3) an improved applicator package that includes a substance (i.e., product) that can be readily applied to a target region wherein the applicator includes a lid that also functions as a handle, and (4) an improved method for using an applicator package that includes a substance in the applicator wherein the applicator includes a lid that also functions as a handle. Such an applicator could be advantageously employed in a variety of applications, including, but not limited to, applications involving consumer products, healthcare/medicine, agriculture, manufacturing, maintenance, construction, and military operations.

The inventors of the present invention have also discovered that it would be desirable to provide, at least for one or more specific types of products or applications, a set of components for assembly as an improved applicator that includes a lid that also functions as a handle, as well as the improved applicator assembled therefrom, wherein the applicator and/or the components therefor could be configured so as to permit the applicator to have one or more of the following attributes or features:

a. a convenient size and configuration that is not bulky,
b. a convenient and aesthetically pleasing shape,
c. a design that prevents or at least minimizes the ingress of dirt or other contaminants from the exterior environment into the applicator,
d. a design that minimizes messiness involving the applicator,
e. a design that prevents or at least minimizes leakage of the product from the applicator,
f. a design that minimizes the likelihood of inadvertent opening of the applicator,
g. a design that has improved robustness and/or durability and/or rigidity,
h. a design that has enhanced ergonomic features,
i. a design that reduces the likelihood of unintended separation or loss of one or more components of the applicator,
j. a design that has a reduced amount of structure or packaging that surrounds and contains the product, and
k. a shape that is comfortable for the user while holding the applicator to apply the product.

The inventors of the present invention have also discovered that it would be desirable to provide, at least for one or more specific types of products or applications, a set of components for assembly as an improved applicator that includes a lid that also functions as a handle, as well as the improved applicator assembled therefrom, wherein the applicator and/or the components therefor, could be configured so as to have one or more of the following advantages:

a. ease of manufacture and/or assembly, and
b. low cost manufacture and/or assembly.

The inventors of the present invention have also discovered that it would be desirable to provide, at least for one or more specific types of products or applications, a set of components for assembly as an improved applicator that includes a lid that also functions as a handle, as well as the improved applicator assembled therefrom, wherein the applicator and/or the components therefor could be configured so as to accommodate applicator operation that has one or more of the following advantages:

a. an operation that is not unduly complex and can be readily determined by the user,
b. an operation that is comfortable, efficient and efficacious,
c. an operation that minimizes, if not eliminates, messiness,
d. an operation that permits easy and effective application of a product to a target region,
e. relatively easy manipulation of the applicator to open and/or close it and/or apply the product,
f. a capability for applying a relatively uniform coating of the product to a target region,
g. a capability for more precisely controlling the application of the product to a target region,
h. a capability for permitting the user to ascertain the amount of product remaining in the applicator, and
i. a capability for permitting the user to apply and "use up" all or most of the product in the applicator.

The inventors of the present invention have further determined that it would be desirable to provide, at least for one or more specific types of products or applications, a set of components for assembly as an improved applicator that includes a lid that also functions as a handle, as well as the improved applicator assembled therefrom, wherein the applicator could be configured to contain, and be used to apply, a variety of substances (i.e., products) to a variety of types of target regions. Such substances can include, but are not limited to, anti-perspirant and/or deodorant, lip balm, lipstick, blush and other cosmetics (e.g., makeup), hair pomades, fragrances, anti-reflective eye marker for use in sports, shoe polish, and the like.

The inventors of the present invention have also discovered that it would be advantageous to provide, at least for one or more specific types of products or applications, an applicator package that (1) includes a lid that also functions as a handle, (2) can be readily carried in a person's pocket or purse, (3) feels comfortable in a person's pocket and in a person's hand, (4) has a sleek appearance, and (5) has a size and configuration accommodating the use of the applicator package by a person away from home—even for applying a substance (i.e., product) in public to a portion of the person's anatomy underneath clothing or to exposed portions of the person's anatomy—in a manner that would not require excessive manipulation, and also preferably without having to remove and hold a replaceable lid or cover separately and apart from the rest of the applicator package.

The inventors of the present invention have also discovered that it would be desirable to provide an improved method of using an applicator with the lid functioning as a handle.

SUMMARY OF THE INVENTION

An aspect of the invention includes a set of components for being assembled as an applicator for use as a package containing a substance that a user can apply to a target region. The set of components comprises a platform and a lid which can function as a handle. The platform has an outer side and has an inner side defining a substance support surface for supporting a substance to be applied to a target region by a user. The lid can be selectively located relative to the platform at (1) a closed position covering a substance on the platform, and (2) a predetermined open position in which the lid is attached to the platform in a way that would expose a substance on the platform. At least a portion of the lid has a configuration for being grasped and used as a handle by a user when the lid is attached in the predetermined open position to the platform so the user can effect movement of the platform to apply the substance by contacting a target region with a portion of the exposed substance. One of the lid and the platform defines an engaging member, and the other of the lid and platform defines (1) a retention abutment surface, and (2) a retention projection that is adjacent, but spaced from, the retention abutment surface to define a recess between the retention abutment surface and the retention projection. One of the lid and the platform includes an axle defining a pivot axis, and the other of the lid and platform includes a receiving member for receiving the axle in a snap-fit engagement to accommodate relative rotation between the lid and the platform about the pivot axis to move the engaging member against and past the retention projection wherein such movement is accommodated by temporary elastic deformation of at least a portion of at least one of the lid and platform so as to locate and releasably retain the engaging member in the recess between the retention abutment surface and the retention projection when the lid is in the open position.

In a preferred form of the set of components, the lid and the platform are initially separately molded and can be subsequently attached together by effecting the snap-fit engagement of the receiving member and the axle. The lid and the platform are configured to permit the lid to be releasably latched to the platform over said the platform inner side when the components are assembled and the lid is in the closed position. The lid and the platform, when assembled together, can establish the predetermined open position at an orientation wherein the lid is between about 150 degrees and about 250 degrees from the closed position.

In a further preferred form of the set of components, the axle is defined by the platform, the axle receiving member is defined by the lid, the engaging member is defined by the platform, the retention abutment surface is defined by the lid, and the retention projection is an arcuate rib defined on the lid.

In another aspect of the invention, an applicator is provided for use as a package containing a substance, and the applicator includes a lid that a user can use as a handle (when the lid is opened and maintained at a particular orientation) to apply the substance to a target region. The applicator comprises a platform having an outer side and having an inner side defining a substance support surface for supporting a substance to be applied to a target region by a user. The applicator also includes a lid that can be selectively located at (1) a closed position covering a substance on the platform, and (2) an open position in which the lid and the platform are connected in a way that exposes a substance on the platform. The lid and platform each has cooperating features that establish the lid in the open position at an orientation that is at least about 150 degrees from the closed position. At least a portion of the lid has a configuration for being grasped and used as a handle by a user when the lid is in the open position so the user can effect movement of the platform to apply the substance by contacting a target region with a portion of the exposed substance.

In a preferred form of the invention, a substance is supported on the platform substance support surface—the applicator and the substance together defining a package.

In a preferred form of the inventive applicator, the lid and the platform are initially separately molded, and the lid and platform each includes a hinge portion cooperating to establish a snap-fit engagement of the hinge portions to define a hinge accommodating opening and closing of the lid about a pivot axis relative to the platform. The cooperating features of the lid and platform that establish the open position at an orientation that is at least about 150 degrees from the closed position preferably function to establish the lid open position between about 150 degrees and about 250 degrees from the closed position. Further, the lid and the platform are preferably configured to permit the lid to be releasably latched to the platform over the platform inner side when the lid is in the closed position.

In the preferred form of the inventive applicator, either the platform or the lid defines an engaging member, and the other of the platform and the lid defines (1) a retention abutment surface, and (2) a retention projection that is adjacent, but spaced from, the retention abutment surface to define a recess between the retention abutment surface and the retention projection for receiving and releasably retaining the engaging member when the lid is in the open position to releasably maintain the lid in the open position when the lid is held by a user to apply the substance.

In the preferred form of the inventive applicator, the retention projection is defined by at least one arcuate rib on the lid.

In another aspect of the invention, a complete applicator package is provided wherein the applicator contains a substance and includes a hinged lid that a user can use as a handle to apply the substance to a target region. The package includes (1) a platform having an outer side and an inner side, (2) a substance on the platform inner side, and (3) a lid having an exterior side and an interior side. A portion of the platform and the lid define a hinged connection accommodating movement of the lid between a closed position covering the substance and an open position exposing the substance. Further, the lid has (1) a distal end opposite the hinged connection, (2) a reduced width gripping region adjacent the hinged connection, (3) an increased width region between the distal end and the reduced width gripping region, and (4) a convex configuration on the exterior side of the lid at the increased width region whereby a user can hold the package in one hand when the lid is in the open position so that the lid can function as a handle wherein (a) the lid convex configuration can be located in the palm of the user's hand, (b) the reduced width gripping region can be gripped between the thumb and at least one finger of the user's hand, and (c) the outer side of the platform can be subjected to a pressing force imposed by the index finger of the user's hand.

In the preferred form of the applicator package, the lid's reduced width gripping region (1) is defined at least in part by a pair of generally planar parallel lateral gripping surfaces, (2) has a width of between about 10 mm and about 60 mm; and (3) has a height of less than about 20 mm. Further, the preferred form of the increased width region has maximum width of between about 25 mm and about 70 mm.

In the preferred form of the applicator package, the maximum height of the increased width region of the lid from said exterior side to said interior side is between about 15 mm and about 25 mm, and the maximum length of the lid is between about 80 mm and about 100 mm.

In the preferred form of the applicator package, the platform outer side has circular concave recess for receiving the end of the user's index finger, and the distance between a midpoint of the length of the reduced width gripping region and the center of the recess is between about 25 mm and about 90 mm when the lid is in the open position.

In the preferred form of the applicator package, each planar parallel lateral gripping surface has a length of about 24 mm.

Another aspect of the invention is a method of applying a substance to a target region comprising the following steps I-V:

I. providing a platform having an outer side and having an inner side defining a substance support surface on which a substance is supported;

II. providing a lid that can be selectively located at (1) a closed position covering a substance on the platform, and (2) an open position in which the lid and the platform are connected in a way that exposes a substance on the platform, and wherein the lid and platform each has cooperating features that establish the lid in the open position at an orientation that is at least about 150 degrees from the closed position, and wherein at least a portion of the lid has a configuration for being grasped and used as a handle by a user when said the lid is in the open position;

III. moving the lid from the closed position to the open position to expose the substance;

IV. grasping the lid with one hand to hold the lid while it is in the open position; and V. moving the open lid to effect movement of the platform to apply the substance by contacting a target region with a portion of the exposed substance.

In a preferred form of the method, steps I and II include providing the lid and the platform configured to permit the lid to be releasably latched to the platform over the platform inner side when the lid is in the closed position; and step III includes unlatching the lid.

In a preferred form of the method, step V includes holding the lid with one hand while extending a finger of that hand alongside the platform outer side and exerting a force with the index finger on the platform outer side in a direction to urge the substance against the target region.

In a preferred form of the method, step I includes providing a bottom cover attached to said platform outer side; and step IV includes pressing the index finger against the bottom cover.

In a preferred form of the method, step III includes pivoting the lid to the open position wherein the orientation of the lid is greater than about 150 degrees from the closed position.

In a presently more preferred form of the method, step III includes pivoting the lid to the open position in which the lid has a self-maintained, but releasable, orientation that is between about 150 degrees and about 250 degrees from the closed position.

It should be appreciated that various forms of the invention may include all of the above-described features, or may include only one or some of the above-described features, or may include any combination of the above-described features. Furthermore, other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

FIG. 10A is a greatly enlarged, fragmentary, cross-sectional view of a portion of the structure enclosed in the circle designated "FIG. 10A" in FIG. 10;

DESCRIPTION OF THE PREFERRED EMBODIMENTS

While this invention is susceptible of embodiment in different forms, this specification and the accompanying drawings disclose only some specific embodiments as examples of the invention. The invention is not intended to be limited to the embodiments so described, and the scope of the invention will be pointed out in the appended claims.

Figure 1:
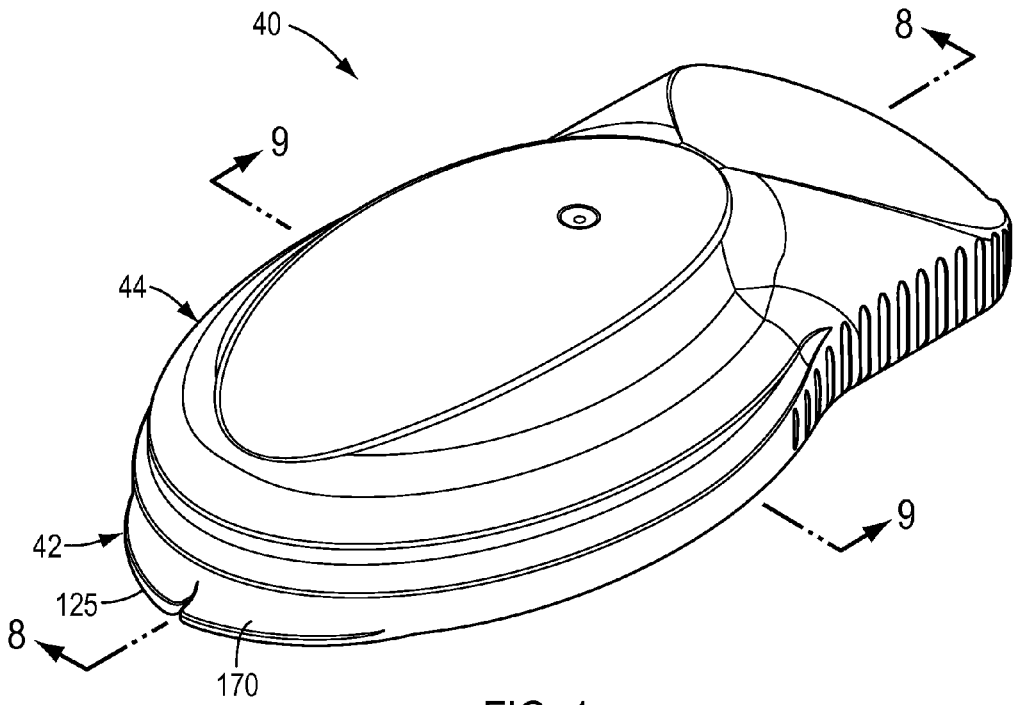
FIG. 1 is an isometric view of an applicator package containing a substance that a user can apply to a target region, and the isometric view is taken from the top front end of the applicator package to show the applicator package components in an initially assembled orientation that defines a fully closed condition as it may be initially provided to a user.

FIG. 1 illustrates a presently preferred embodiment of an applicator package 40 of the present invention wherein the package 40 is shown in an initially closed condition. FIGS. 2-11 illustrate other views of the applicator package 40, including some views wherein the applicator package 40 is shown open, and some views in which features are shown in cross-section.

In the presently preferred form of the applicator package 40 illustrated in FIGS. 1-11, the applicator package 40 is especially suitable for use as an applicator package containing an antiperspirant/deodorant product (i.e., substance) 48 which can be applied by the user. One form of the applicator package 40 has a relatively small overall size, even when fully open (FIGS. 4 and 5), so that a user can readily grasp and hold the applicator package, and then conveniently apply the substance (such as an antiperspirant/deodorant to the person's underarms, including even underneath a person's shirt or blouse—even while in public).

FIG. 1 illustrates the applicator package 40 from above and looking down on what can be characterized as the "top" of the applicator package 40 when the applicator package is in its closed condition.

Figure 2:
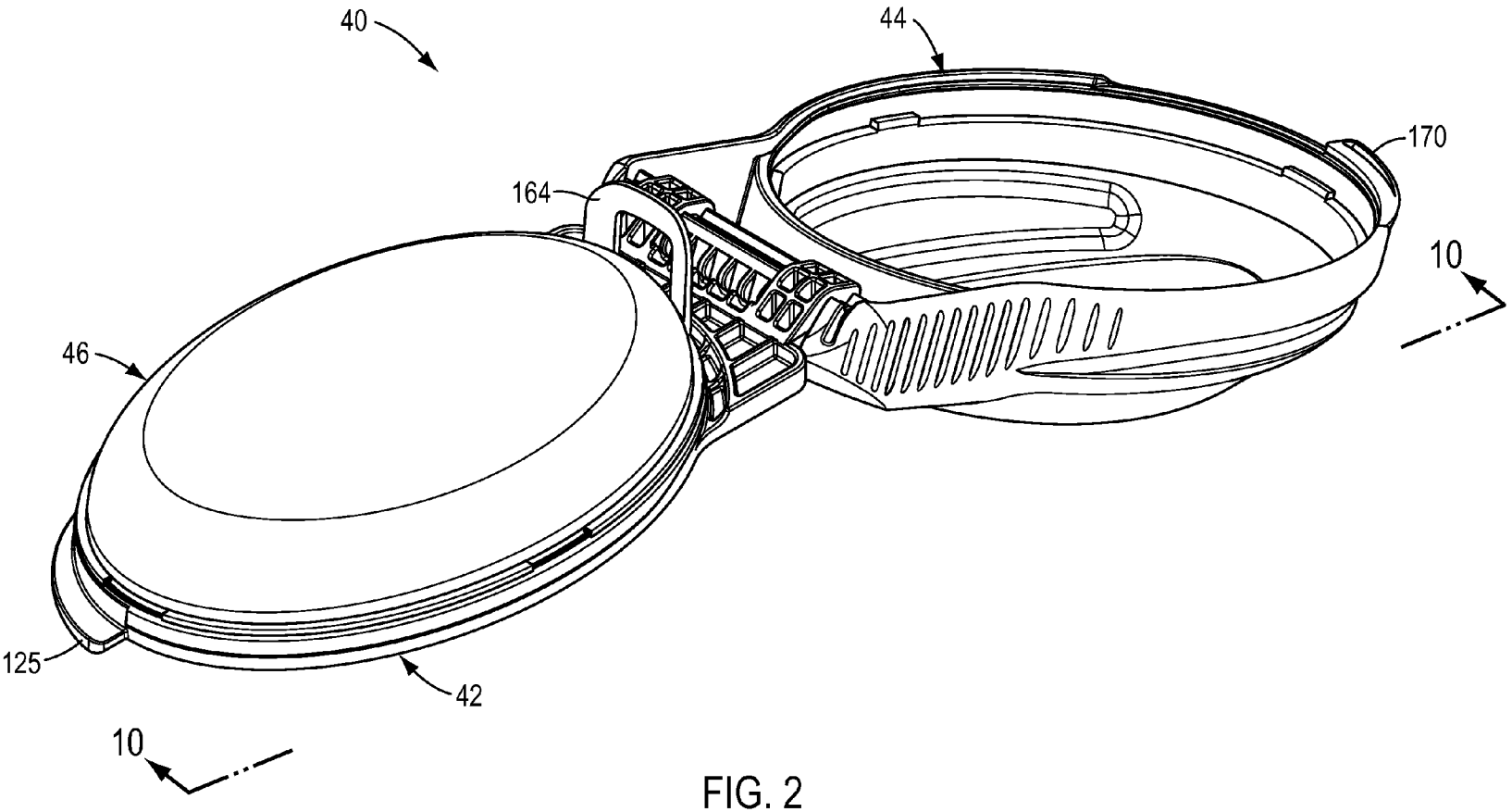
FIG. 2 is an isometric view of the applicator package shown in FIG. 1, but in FIG. 2 the applicator package has been opened by pivoting open the hinged lid to a fully opened position.

With reference to FIG. 2, the applicator package 40 includes a platform 42 to which is initially attached a dome, such as a "fill cap" or inner side cap 46 or such as a lid 44 that can be moved from the full opened, stable position as shown in FIG. 2 to the fully closed position as shown in FIG. 1, and vice versa. In some alternate forms of the invention (not illustrated), the inner side cap 46 may be omitted, but if the inner side cap 46 is included (along with the lid 44), then the "fill cap" or inner side cap 46 (as described below with reference to FIG. 2) initially functions as a dome to confine the product on the platform 42 during initial filling of the package 40 with the product In the illustrated preferred embodiment, the inner said cap 46 and lid 44 are both included in the package 40, and the inner side cap 46 functions as a dome directly over the platform 42. In an alternate embodiment (not illustrated) where the inner side cap 46 is omitted, the lid 44 functions as the dome directly over the platform 42 to confine the product on the platform 42 during initial filling of the package 40 with the product.

Figure 3:
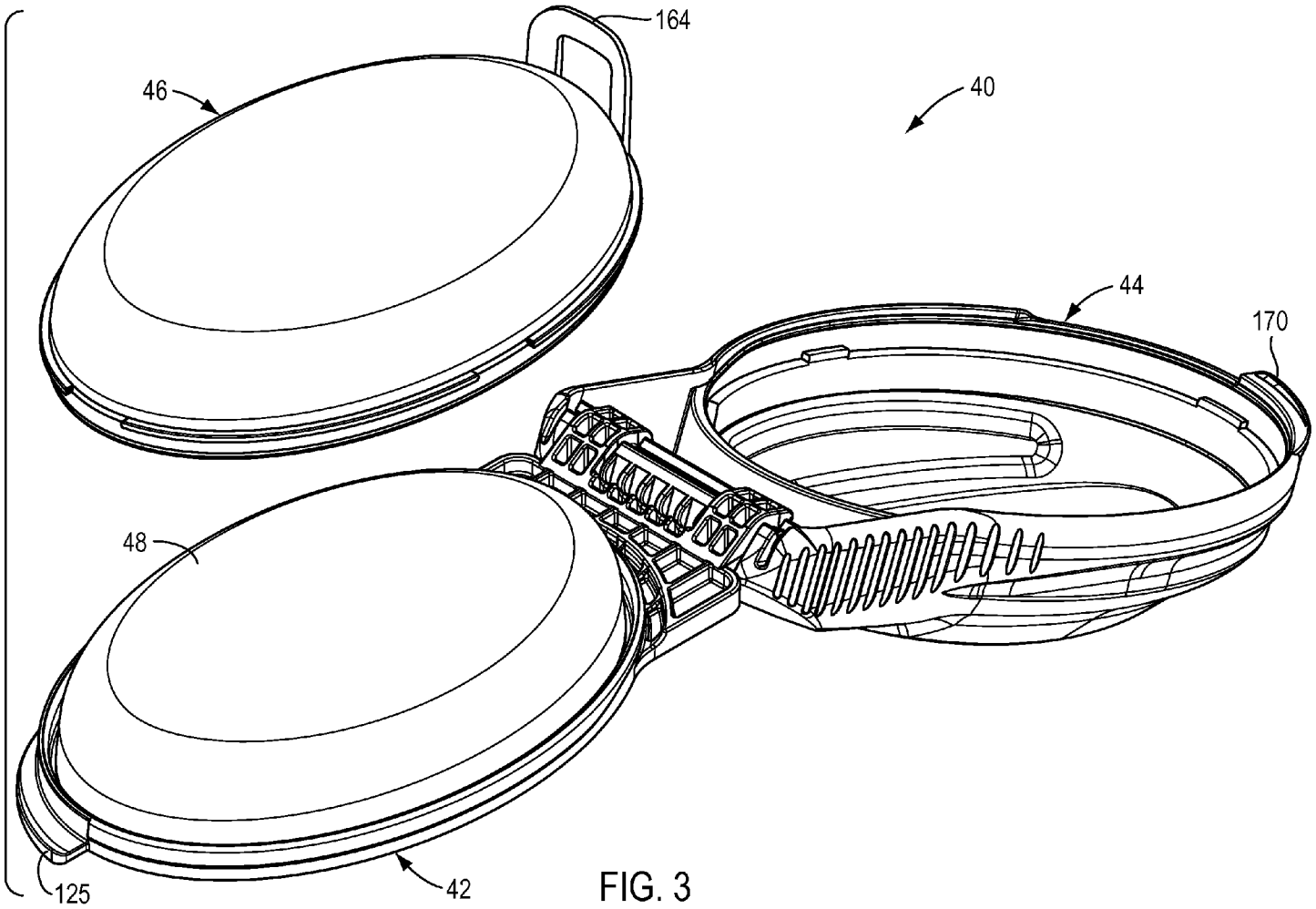
FIG. 3 is an isometric view similar to FIG. 2, but in FIG. 3 a releasable, inner side cap is shown removed from, and above, the underlying remaining portion of the applicator package.

As can be seen in FIGS. 2 and 3, the preferred form of the applicator package 40 initially includes a dome in the form of a "fill cap" or an inner side cap 46 which is removable by a user from the platform 42 so as to expose a substance 48 (FIG. 3) on the platform 42. Such a substance 48 typically would be a product to be applied by the user to a target region.

In various forms of the invention, the lid 44 or inner side cap 46 may be characterized as a "dome" having an interior concave region and an exterior convex configuration. In one form of the invention (not illustrated), the inner side cap 46 may be omitted altogether, and the lid 44 can be used as a dome during manufacture of the package to define a concave region into which the substance 48 is injected onto the platform 42. However, in the presently preferred form of the invention illustrated in FIGS. 1-11, the inner side cap 46 functions as a dome during manufacture of the package 40 to define a concave region into which the substance 48 is injected on the platform 42 as described in detail hereinafter.

The term "dome" as used herein is not intended to mean a purely hemispherical shape. Rather, as used herein, the term "dome" refers generally to a structure that projects outwardly and that has an inner or interior side defining a concave region. The dome's interior side (and the outer side) need not be smooth and need not be defined by a curved surface or surfaces.

In the presently preferred form of the illustrated applicator package 40, the applicator package lid 44 is adapted to be opened to a predetermined orientation (which may be defined as an angle of opening relative to the platform 42) so that the lid 44 can be used as a handle by the user when the applicator package 40 is opened, and this assists the user in efficaciously applying the substance to the target region.

Figure 6:
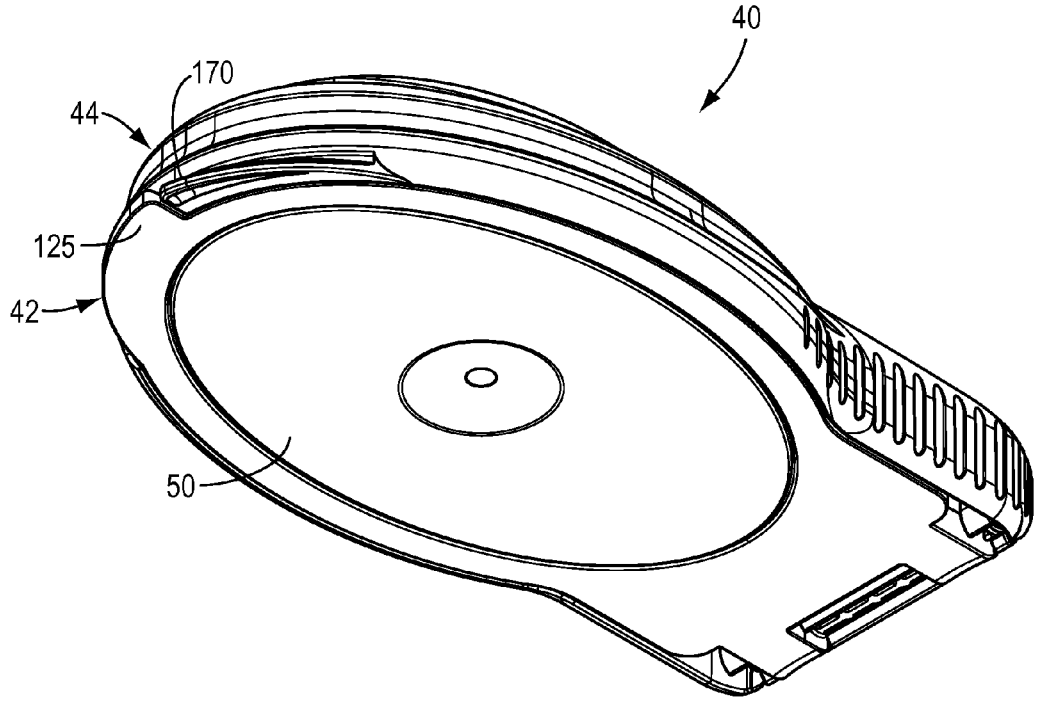
FIG. 6 (on the drawing sheet with FIG. 1) is an isometric view of the applicator package of FIG. 1 in the fully closed condition, but in FIG. 6 the isometric view is taken from below the applicator package.
Figure 4:
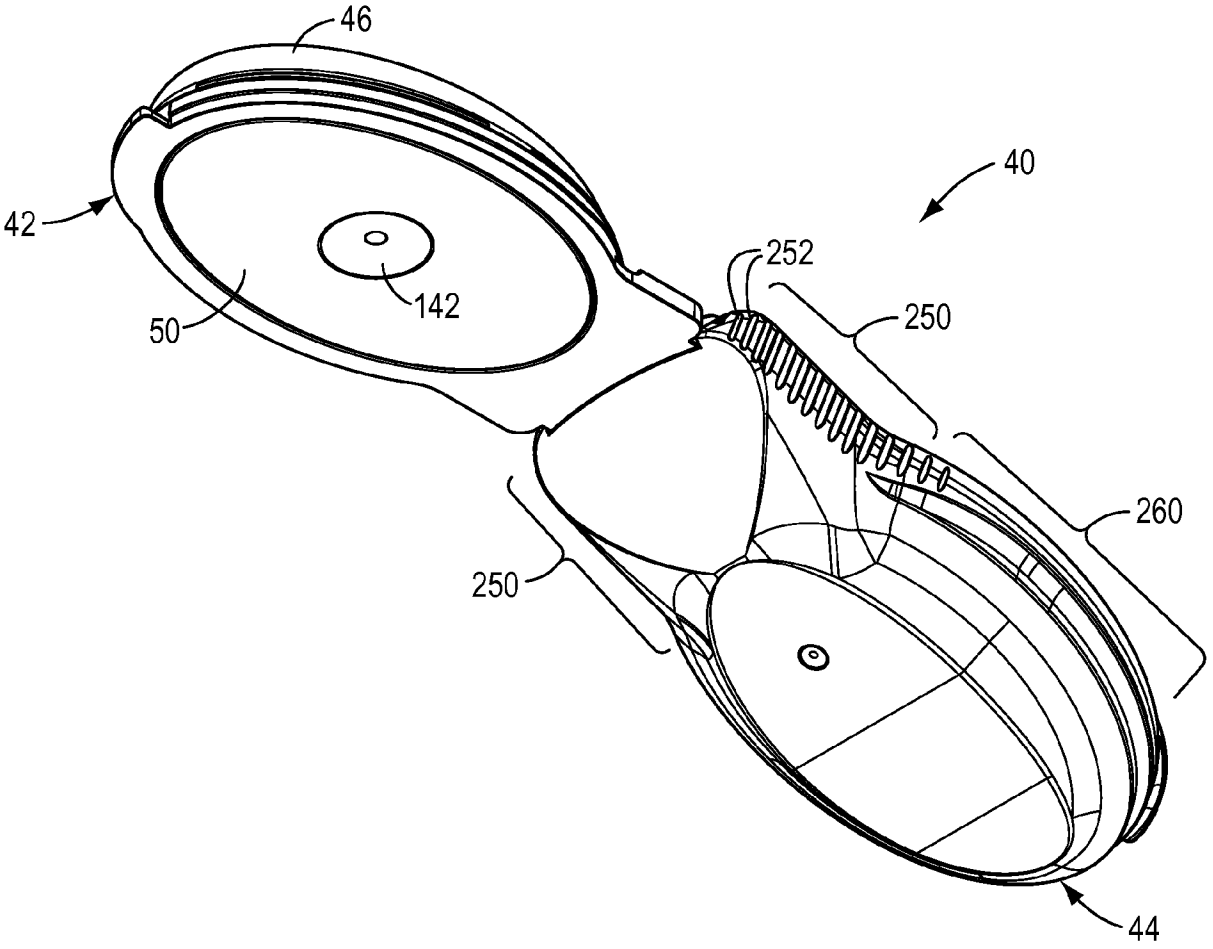
FIG. 4 is an isometric view of the opened applicator package shown in FIG. 2, but in FIG. 4 the isometric view is taken from below the opened applicator package.

As can be seen in FIGS. 4 and 6, the preferred embodiment of the applicator package 40 also includes a "plug plate" or bottom cover 50 which is inserted into, and mounted to, the bottom of the platform 42.

Without the substance (i.e., the product) 48 on the platform 42, the components may be characterized as comprising an applicator. The assembly of the components with the substance (e.g., product) 48 in place on the platform 42 may be characterized as constituting the complete applicator package 40 of which the substance 48 would be a part. In one of the broad aspects of the present invention, the set of applicator components, and the applicator assembled therefrom, includes at least the platform 42 and lid 44, but not necessarily also the substance 48 and not necessarily also the inner side cap 46 and/or bottom cover 50.

Figure 14:
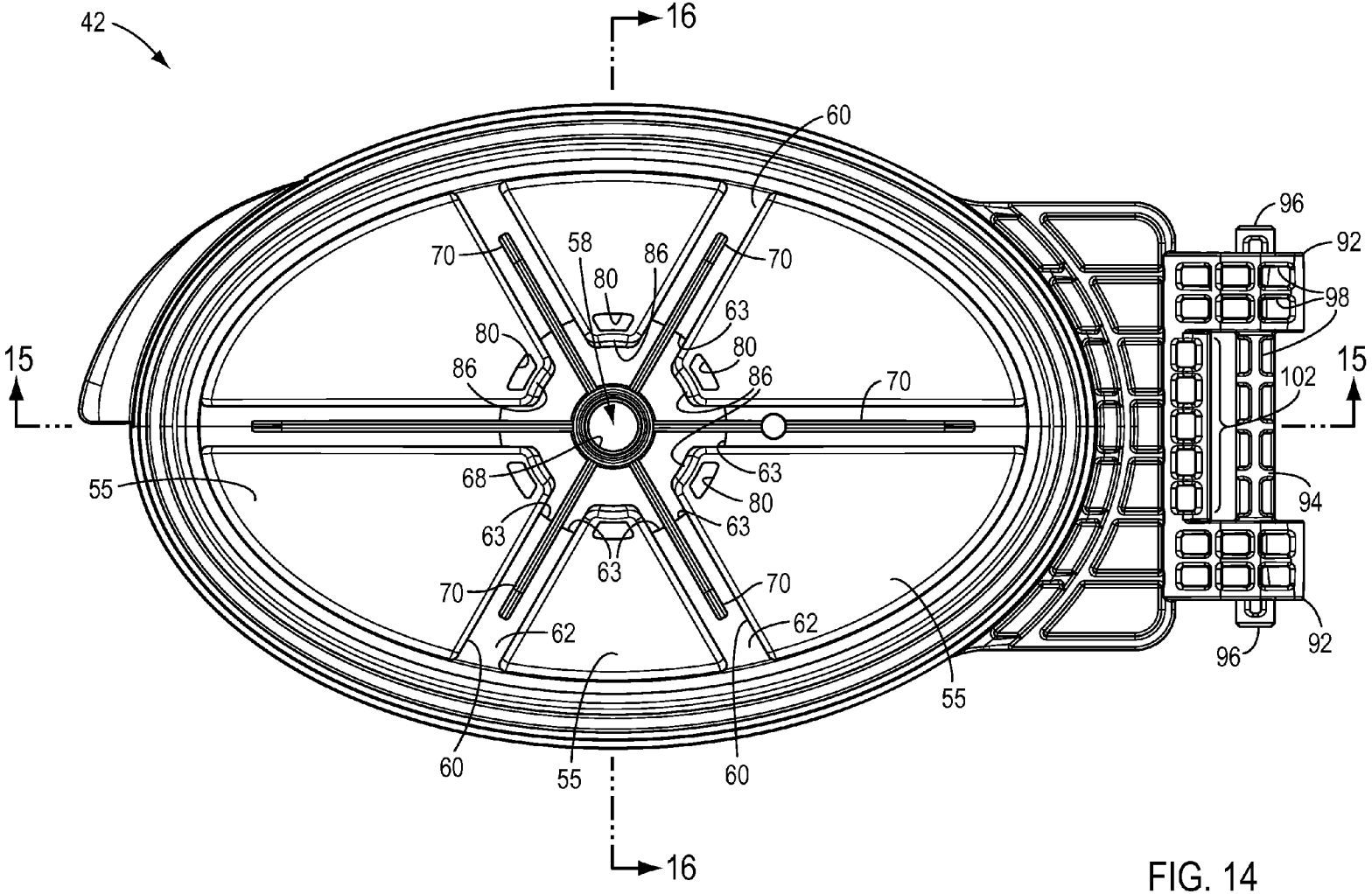
FIG. 14 is a top plan view of the platform.
Figure 15:
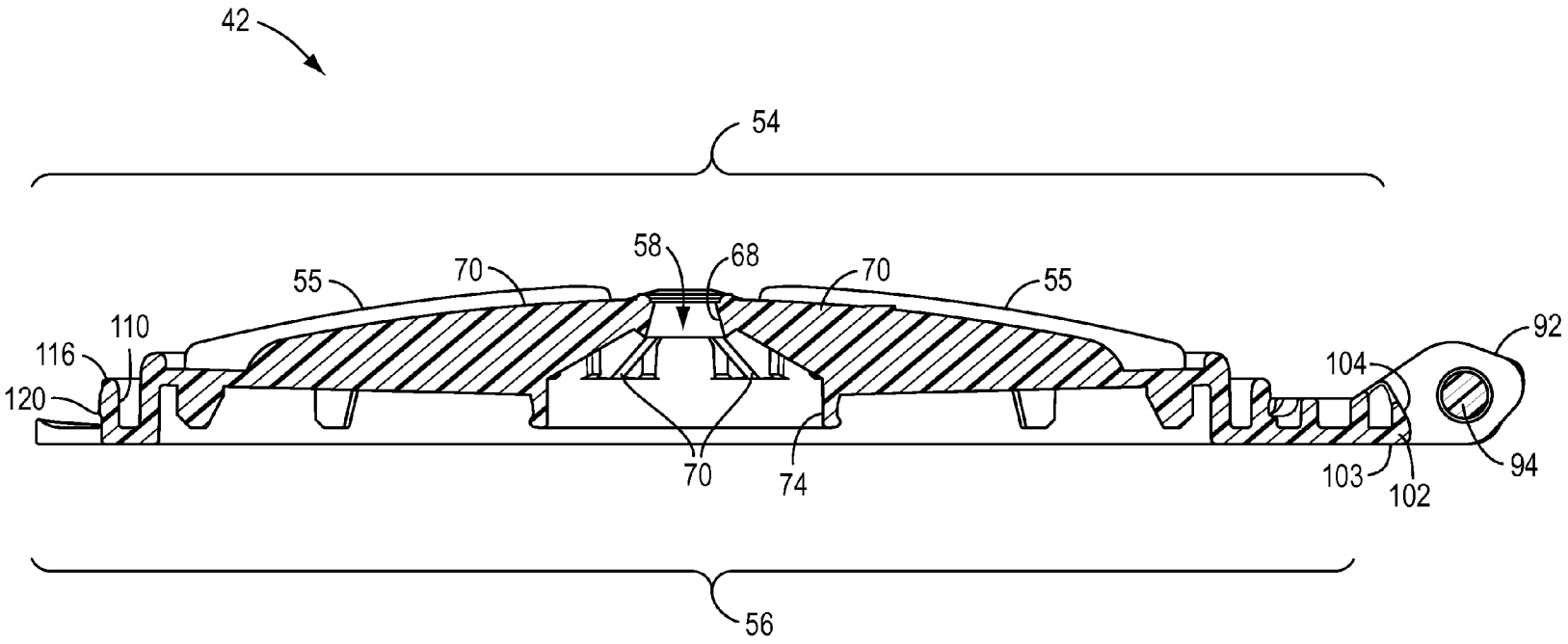
FIG. 15 is a cross-sectional view taken generally along the plane 15-15 in FIG. 14.
Figure 16:
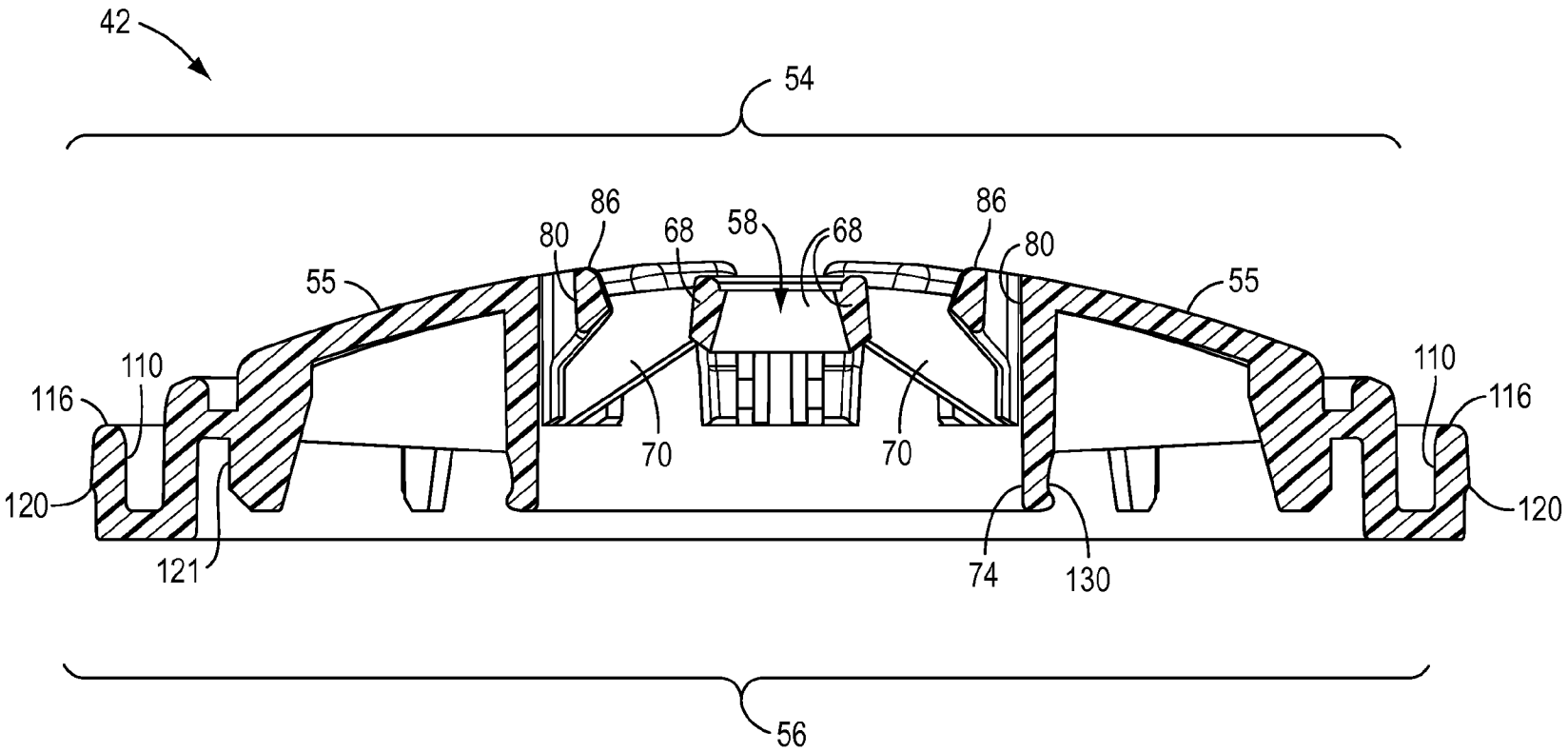
FIG. 16 is a cross-sectional view taken generally along the plane 16-16 in FIG. 14.

The platform 42 alone is illustrated in FIGS. 12-16. With reference to FIG. 16, the platform 42 may be characterized as having an inner side 54 on the "top" of the platform 42 for supporting the substance 48 (e.g., a product such as an antiperspirant/deodorant)—the substance not being illustrated on the platform 42 in FIGS. 12-16, but being illustrated in other figures of the applicator package such as FIGS. 5, 8, and 10 wherein the substance is designated by the reference number 48. The platform inner side 54 defines a substance support surface or surfaces 55 for supporting the substance 48 (e.g., a product such as antiperspirant/deodorant).

With continued reference to FIG. 16, the platform 42 includes an outer side 56 which faces in generally the opposite direction from the inner side 54 and which may be characterized as being located at the "bottom" of the platform 42.

As can be seen in FIG. 16, the platform 42 defines one (or at least one) fill passage 58 that extends from the platform outer side 56 to the platform inner side 54.

Figure 12:
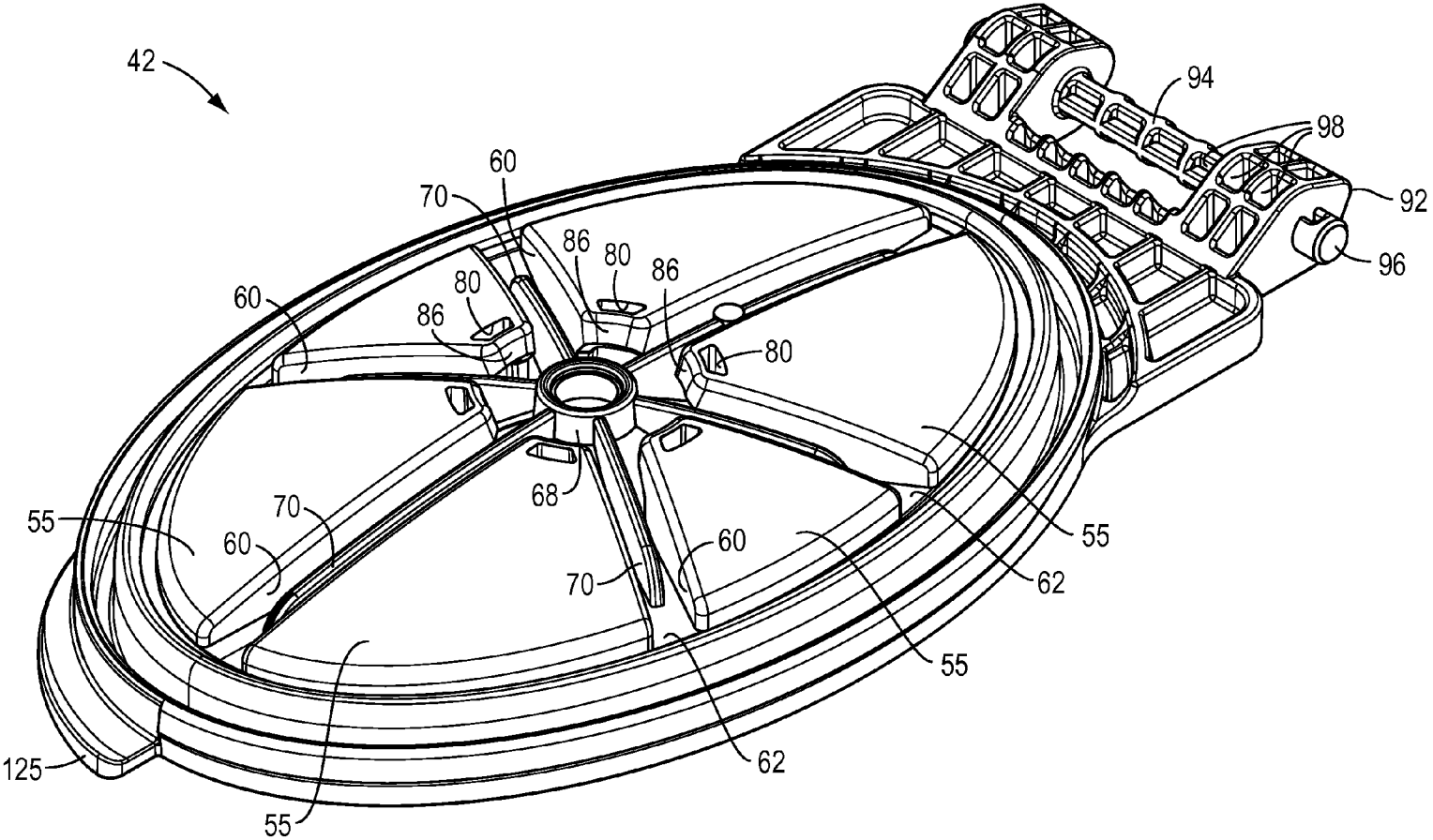
FIG. 12 is an isometric view of only the platform component of the applicator package, and in FIG. 12 the isometric view is taken from the top front end of the platform looking toward the rear end.
Figure 13:
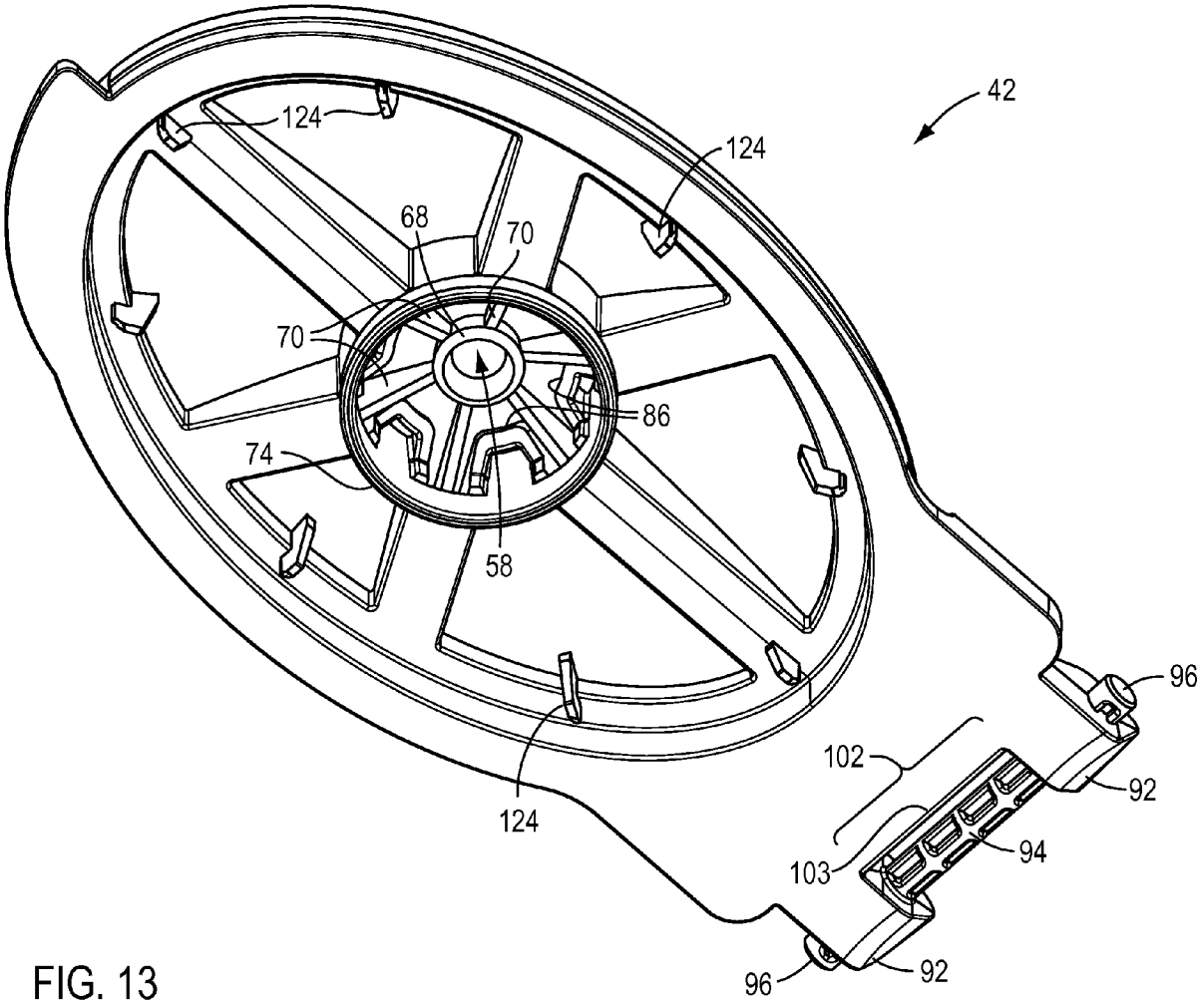
FIG. 13 is an isometric view of the platform shown in FIG. 12, but in FIG. 13 the platform is viewed from the bottom.

With reference to FIGS. 12 and 14, the platform 42 also defines at least one channel 60. In the illustrated, preferred embodiment as shown in various ones of the FIGS. 1-29, there are six (6) such channels 60 defined in the substance support surface 55 of the platform 42. As can be seen in FIG. 12, each channel 60 is elongate and has a bottom floor 62. Each channel bottom floor 62 terminates at one interior end 63 (FIG. 14) so as to define at least one open end communicating through the platform 42 to the platform outer side 56. Each channel 60 may be characterized as extending generally laterally outwardly from a location near, but spaced from, the fill passage 58.

With reference to FIGS. 12, 14, 15, and 16, the fill passage 58 is defined by a generally ring-like conduit 68 which is supported about its periphery by a plurality of ribs 70. Each channel 60 contains one rib 70 which projects upwardly from the channel floor 62. Each rib 70 also extends laterally inwardly beyond the inward end of the channel floor 62 so that it is connected to, and supports, the fill passage conduit 68. In the preferred embodiment illustrated, the height of each rib 70 is somewhat lower than the adjacent portions of the platform substance support surface 55 on either side of each channel 60.

As can be seen in FIGS. 13, 15 and 16, the platform outer side 56 includes a "fill chimney" or containment wall 74. In the illustrated, preferred embodiment, the containment wall 74 is generally cylindrical and is connected with, and supported at, the ends of the channel floors 62 and at the underside of the substance support surface 55. On each side of each rib 70, each channel open end (defined at the end 63 of the channel floor 62) communicates through the platform 42 between the inner side 54 and the outer side 56 within the containment wall 74.

As can be seen in FIG. 14, near the center of the platform 42, the support surface 55 defines apertures 80 which communicate through the platform 42 from the support surface 55 to the platform outer side 56 inwardly of the containment wall 74.

Laterally inwardly beyond each aperture 80, the substance support surface 55 extends further inwardly as an end projection 86 and terminates at a location spaced from the fill passage conduit 68 so as to define an opening between the projection 86 and the conduit 58.

With reference to FIGS. 12, 13, 14, and 16, the projections 86 of the support surface 55 that extend laterally inwardly of the apertures 80 are cantilevered over, or "overhang", a void space within the containment wall 74. The overhanging portions or end projections 86 of the support surface 55 may be characterized as projections 86 which also extend from the containment wall 74. The substance 48 (e.g., product such as an antiperspirant/deodorant) engages the projections 86—both on the inner side 54 of the platform 42 as well as on the outer side 56 of the platform 42, as explained in detail hereinafter.

The rear end of the platform 42 includes a cooperating hinge portion for cooperating with a mating hinge portion on the lid 44 described hereinafter. The platform hinge portion can be seen in FIGS. 13 and 14 as including a pair of spaced-apart rear projections 92. A center axle 94 extends between, and connects, the two rear projections 92. On the laterally outer side of each projection 92, there is a stub axle 96. Each stub axle 96 and the center axle 94 lie along a straight line defining a common axis about which the platform 42 and lid 44 can be pivoted so as to affect opening and closing of the two components as described in detail hereinafter.

To reduce the amount of material required in the platform hinge portion structure, the hinge portion is preferably provided with a plurality of recesses 98 (FIGS. 12 and 14). Such recesses 98 are especially desirable for reducing the amount of required material if the platform 42 is molded from a thermoplastic material, such as polypropylene, polyethylene, and the like.

Adjacent, but spaced inwardly of, the center axle 94 is an engaging member 102 as can be seen in FIGS. 13 and 14. As can be seen in FIGS. 10A, 13, and 15, the engaging member 102 defines an outer surface 103 and an inner end surface 104. As explained in detail hereinafter, the engaging member 102 is adapted to interact with, and engage, a portion of the lid 44 during the process of opening the lid 44 as described in detail hereinafter.

Figure 9:
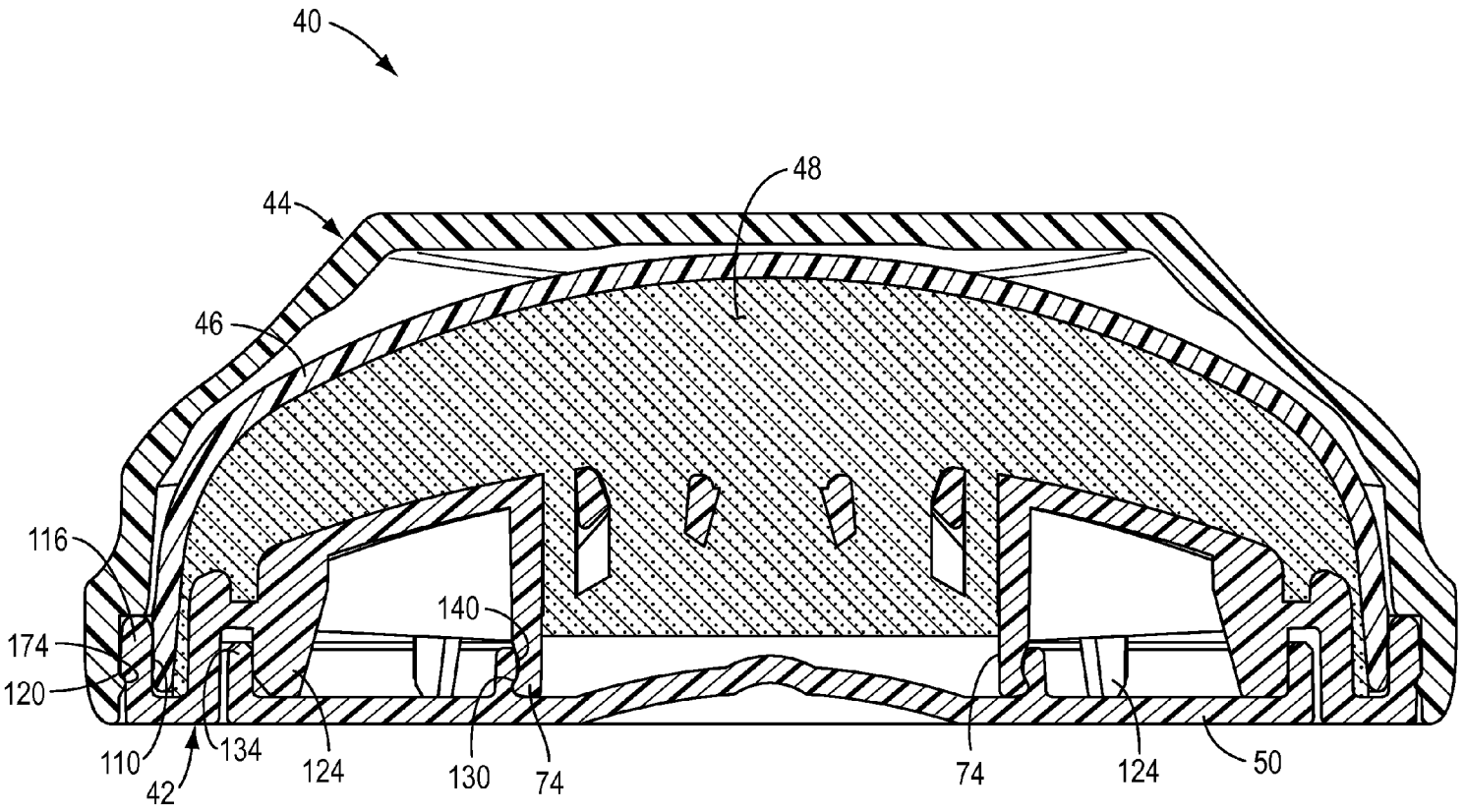
FIG. 9 is a cross-sectional view taken generally along the plane 9-9 in FIG. 1.

As can be seen in FIG. 15, the platform 42 includes a peripheral channel 110 around the support surface 55, and the channel 110 receives a lower edge of the inner side cap 46 when the inner side cap 46 is initially installed on the platform 42 (see FIGS. 2 and 9). As can be seen in FIG. 9, the outer wall of the channel 110 is defined by a peripheral, upwardly projecting flange 116. The exterior surface of the lower edge portion of the inner side cap 46 frictionally engages the channel outer wall defined by the flange 116. This accommodates removal of the inner side cap 46 by the user when the user initially opens the package lid 44.

With reference to FIGS. 15 and 16, the platform peripheral flange 116 also defines, on its laterally outwardly facing surface, an undercut 120 for engaging a feature on the lid 44 when the lid 44 is in the closed position as described in detail hereinafter.

As can be seen in FIG. 12, the platform 42 includes that its front end (opposite the rear end or hinge) and an outwardly projecting tab 125 which can be engaged by a finger or thumb of the user during the process of opening the package when the lid 44 is moved away from the platform 42 (e.g., to the opened position illustrated in FIG. 2).

As can be seen in FIG. 13, the platform 42 includes, on its bottom or outer side, a plurality of ribs 124 which serve to guide and stabilize the bottom cover 50 when the bottom cover 50 is mounted to the bottom of the platform 42. In order to secure the bottom cover 50 to the bottom of the platform 42, the exterior lower end portion of the fill chimney or conduit 74 defines an annular groove 130 (FIG. 16) for receiving a complementary feature of the bottom cover 50 as described in detail hereinafter.

Figure 17:
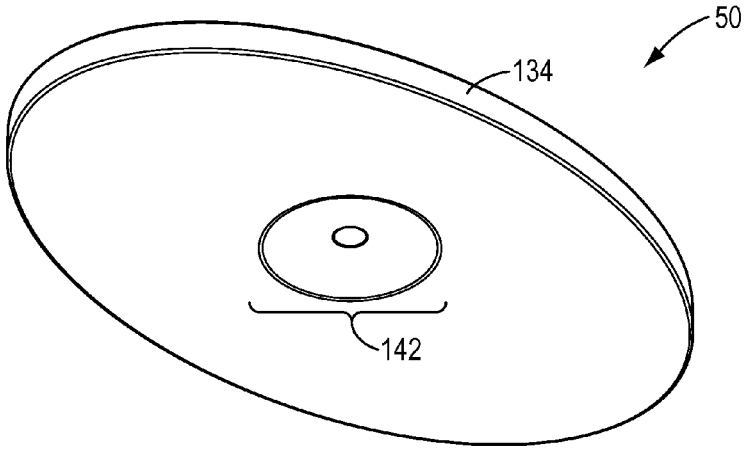
FIG. 17 is an isometric view of the exterior (bottom) of only the plug plate component of the applicator package shown in FIG. 1.
Figure 18:
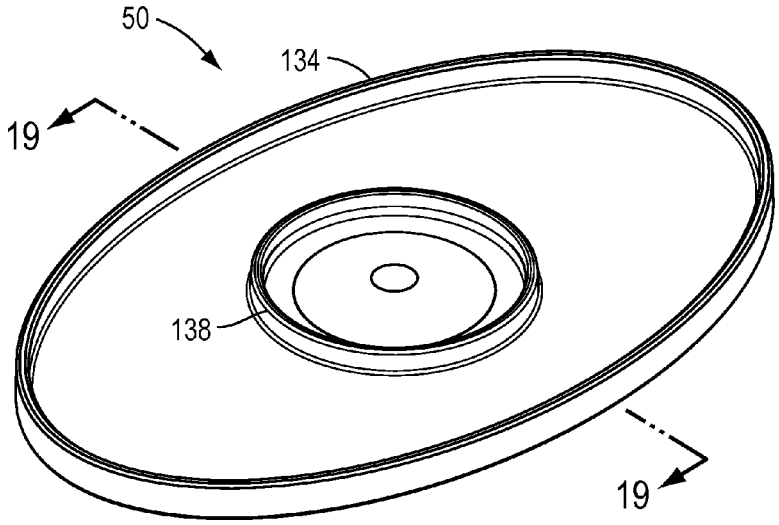
FIG. 18 is an isometric view of the plug plate shown in FIG. 17, but in FIG. 18 the plug plate is viewed from the interior (top) of the plug plate.
Figure 19:
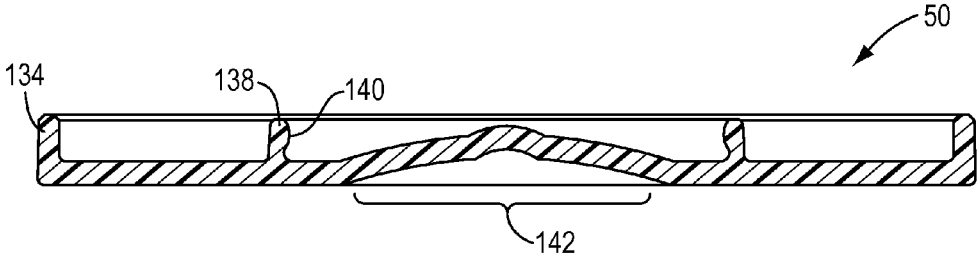
FIG. 19 is a cross-sectional view taken generally along the plane 19-19 in FIG. 18.
Figure 21:
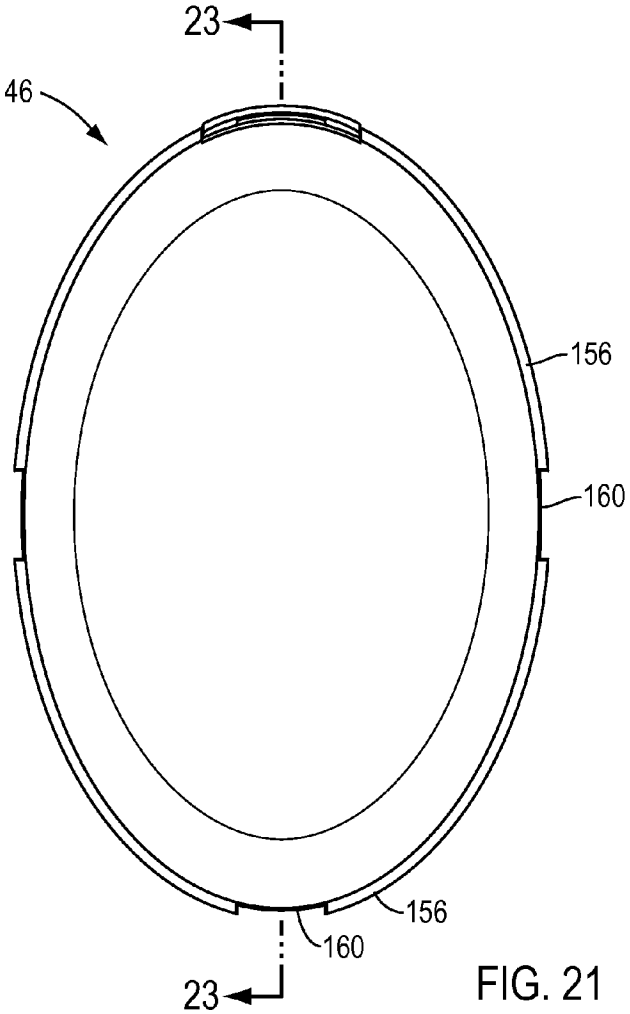
FIG. 21 is a top plan view of the releasable, inner side cap.

The bottom cover 50 by itself is illustrated in FIGS. 17-19. With reference to FIGS. 17-19, the bottom cover 50 includes a peripheral flange 134 and an inner flange 138. The inner flange 138 includes a radially inwardly extending annular bead 140 (FIG. 19). After the platform 42 is filled with a substance 48 as described in detail hereinafter, the bottom cover 50 is installed on the bottom of the platform 42 in a snap fit engagement wherein the bottom cover annular bead 140 is received in the annular groove 130 of the platform fill chimney or conduit 74. The snap fit installation of the bottom cover 50 on the platform 42 is preferably quite strong so that a user of the applicator package 40 would not be able to easily remove the bottom cover 50.

The bottom cover 50 has an indented or recessed, generally circular, region 142 as seen in FIG. 19. From the exterior (i.e., the bottom, exposed portion of the bottom cover 50), the recessed region 142 serves to identify or signify a central region on which a user can push with the user's index finger after the user opens the package and then applies the substance to the target region as explained in detail hereinafter.

FIGS. 20-23 illustrate the inner side cap 46 alone. The inner side cap 46 has a configuration for being mounted on the platform 42 and initially covering the substance 48 (e.g., the product to be applied) prior to removal of the inner side cap 46 by the user (compare FIGS. 2, 8, 9, and 10).

Figure 22:
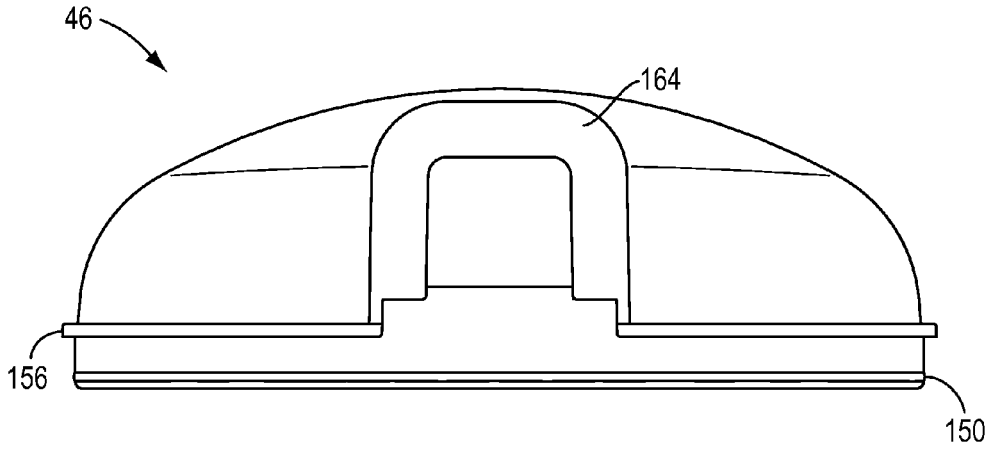
FIG. 22 is an end view of the releasable, inner side cap taken from the right hand end (with reference to the orientation of the inner side cap as shown in FIG. 20)
Figure 23:
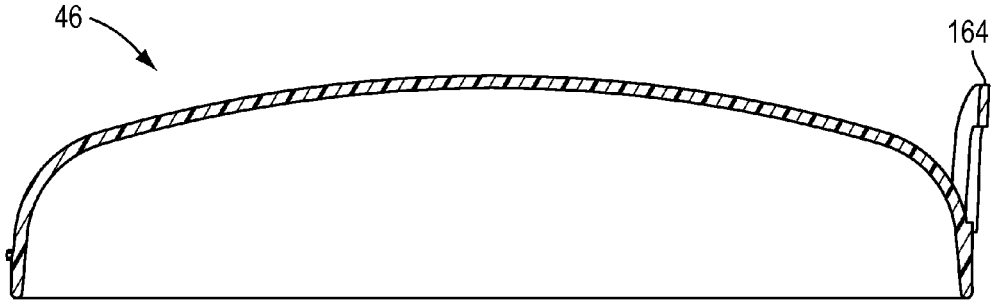
FIG. 23 is a cross-sectional view taken generally along the plane 23-23 in FIG. 21.

As can be seen in FIG. 22, the lower portion of the outer periphery of the inner side cap 46 defines a retention bead 150. The bead 150 is adapted to be received in the platform channel 110 (FIG. 16) so as to establish a press fit frictional engagement with the inwardly facing side of the platform flange 116 that defines the channel 110. The frictional engagement is established by a slight compressive force on the periphery of the bead 150 of the inner side cap 46.

Figure 20:
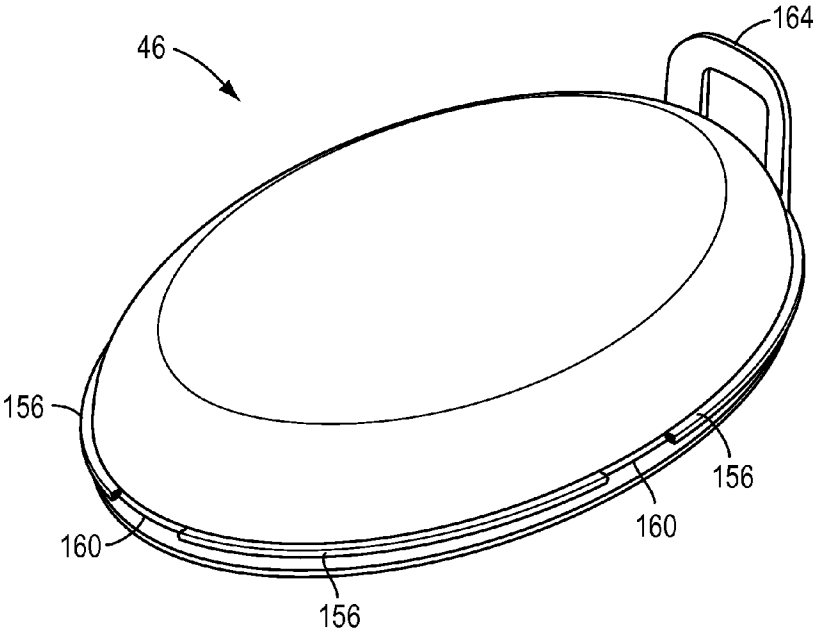
FIG. 20 is a isometric view of only the releasable, inner cap component of the applicator package shown in FIG. 1 and in FIG. 20 the isometric view is taken from the top front end of the releasable, inner side cap looking toward the rear end.

As can be seen in FIG. 20, the inner side cap 46 includes a plurality of laterally extending beads 156 which serve as stops with respect to seating the cap 46 on the platform 42 at the top of the platform peripheral flange 116. There are notches between the ribs 156 on the cap 46, and each of these notches 160 is configured to receive a rib of the lid 44 when the lid 44 is closed as explained in detail hereinafter.

With reference to FIG. 20, the cap 46 includes a pull tab 164 at one end, and a user is able to grasp the pull tab 164 to initially lift the inner side cap 46 off of the platform 42 to expose the substance 48 when the package 40 is first opened. In the preferred embodiment wherein a lid 44 is included as part of the package 40, the user need not retain and replace the inner side cap 46 on the platform 42 after initially removing the cap 46. Therefore, the user may dispose of the inner side cap 46 after removing it.

Figure 24:
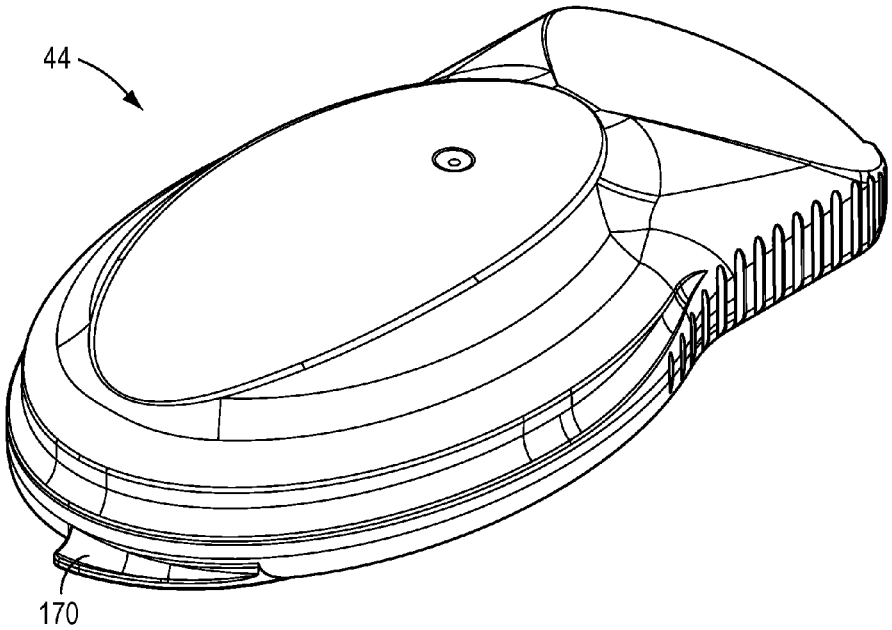
FIG. 24 is an isometric view of only the lid component of the applicator package shown in FIG. 1, and in FIG. 24 the isometric view is taken from the top front end of the lid looking toward the rear end (hinge end) of the lid.
Figure 27:
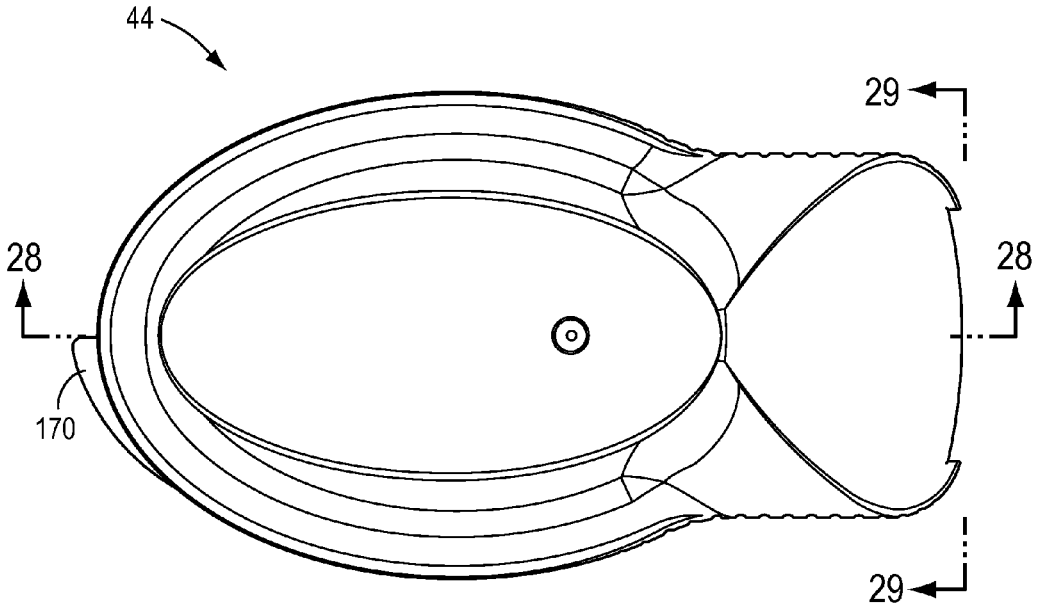
FIG. 27 (on the drawing sheet with FIG. 24) is a top plan view of the lid.
Figure 25:
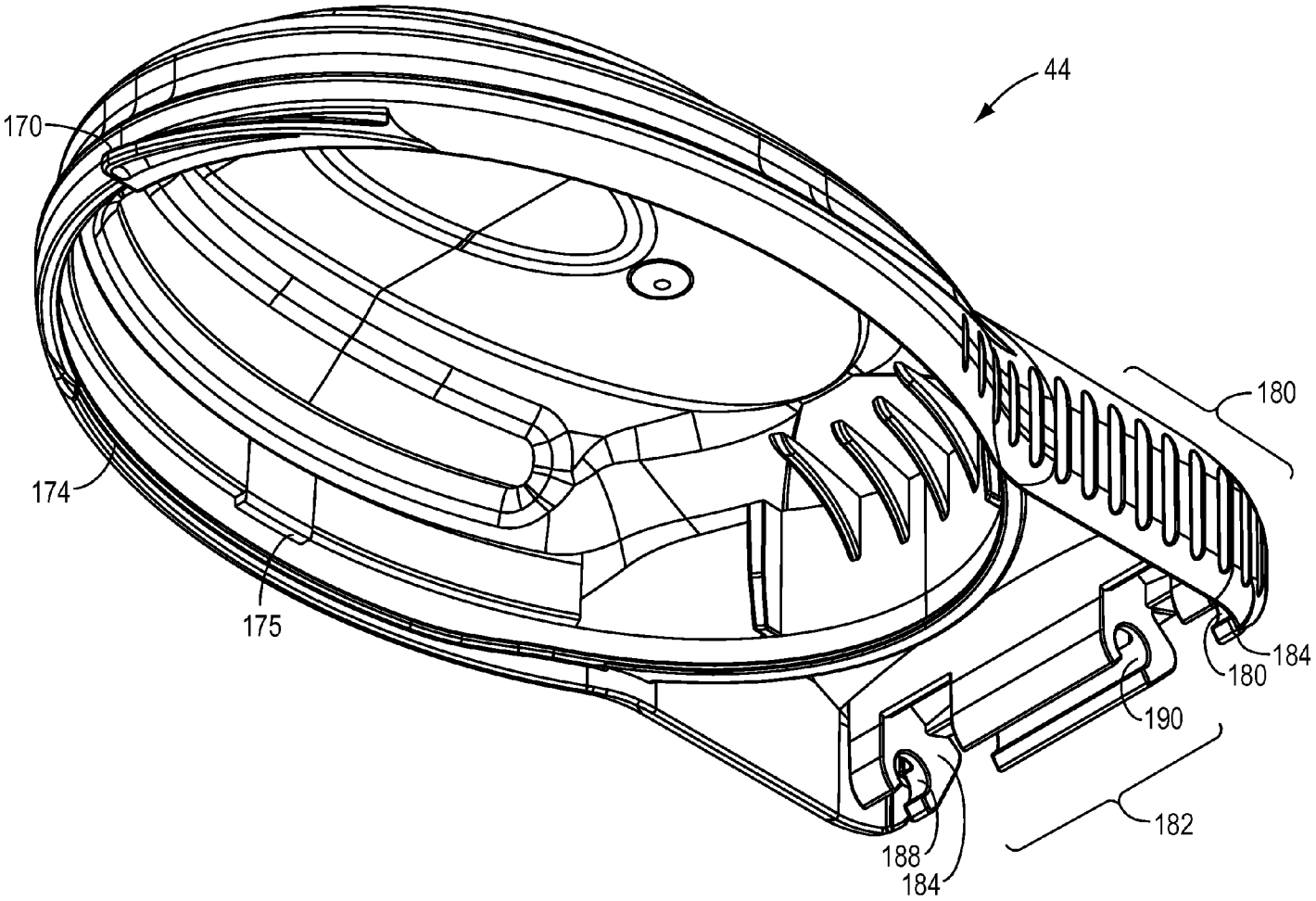
FIG. 25 is an isometric view of the lid taken from below the lid looking toward the rear end (hinge end) of the lid.

The lid 44 by itself is illustrated in FIGS. 24-29. With reference to FIGS. 24 and 25, the lid 44 has a configuration and volume that can cover the top of the platform 42 (FIGS. 1 and 8) in a way that covers and protects the initially installed inner side cover 46 and the substance 48 under the cover 46. In the illustrated preferred embodiment, the lid 44 is pivotally mounted to one end of the platform 42 and can be rotated or pivoted relative to the platform 42 from the closed position illustrated in FIGS. 1 and 6 to the open position illustrated in FIGS. 3-5, and vice versa. To this end, the front of the lid 44 includes a finger or thumb lift tab 170 which can be engaged by the user in conjunction with the user also engaging the previously described platform engagement tab 125 (FIGS. 1 and 2).

Figure 28:
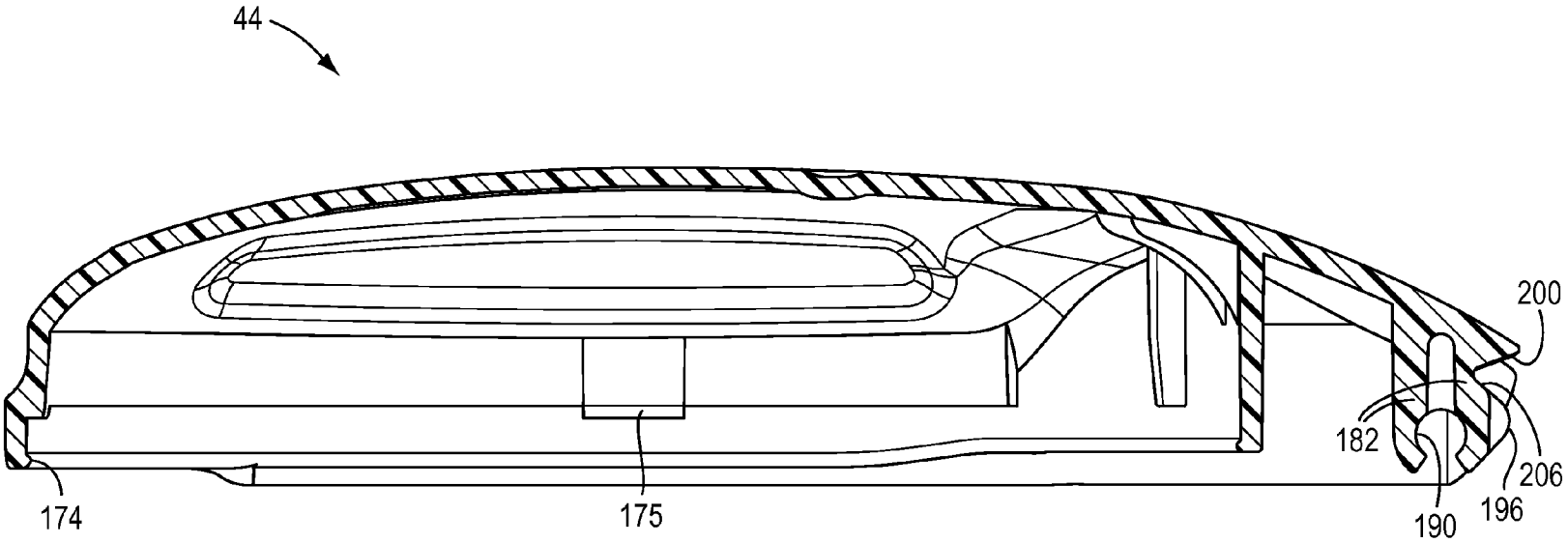
FIG. 28 is a cross-sectional view taken generally along the plane 28-28 in FIG. 27.
Figure 29:
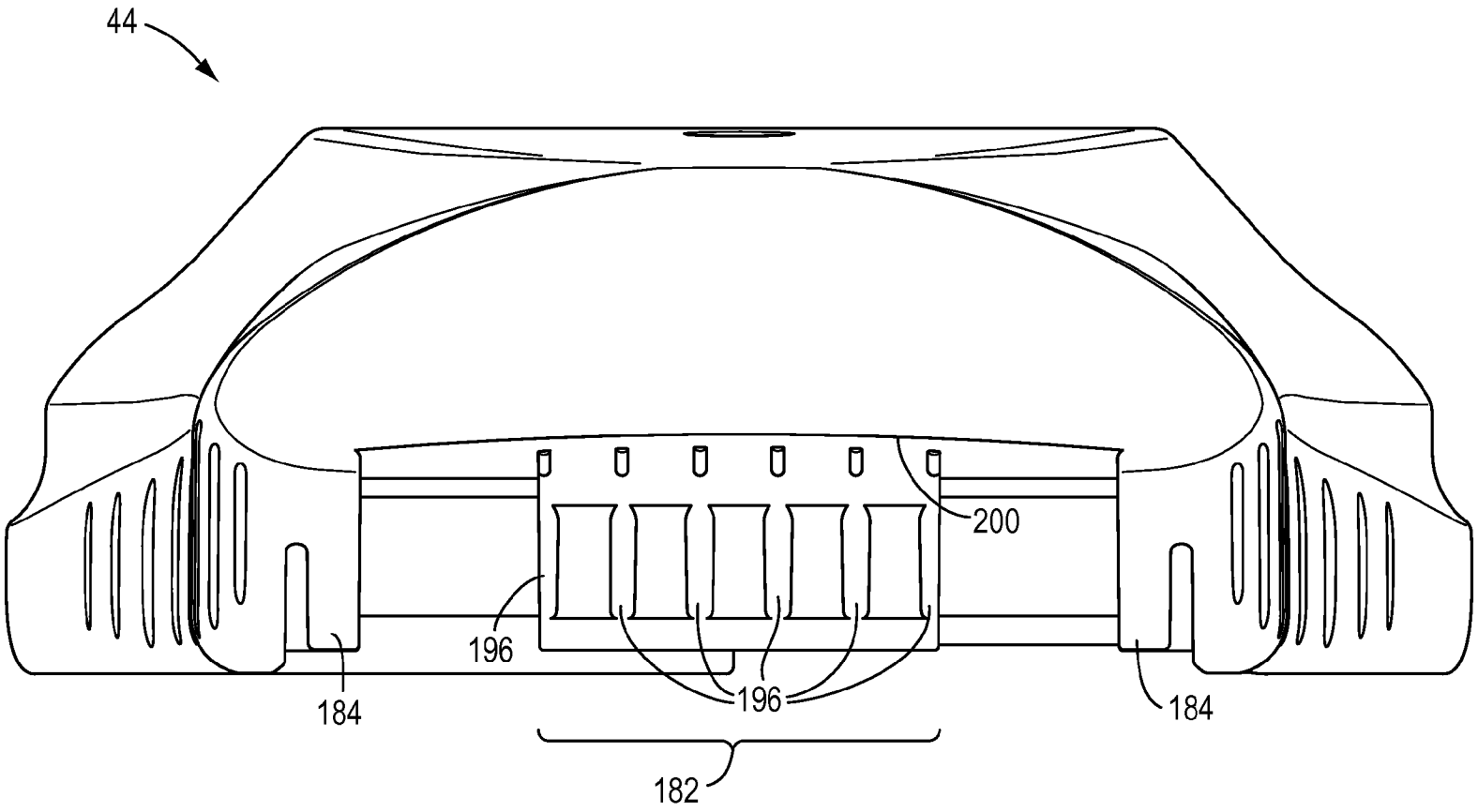
FIG. 29 is an end elevation view of the lid taken generally along the plane 29-29 in FIG. 27.

As can be seen in FIGS. 25 and 28, a lower edge portion of the lid 44 includes an inwardly projecting retention bead 174. When the lid 44 is in the fully closed position on the platform 42 as shown in FIG. 9, the lid retention bead 174 engages the previously described undercut 120 on the outside of the platform flange 116. The lid retention bead 174 and the platform undercut 120 accommodate relative movement between the lid 44 and the platform 42 as the lid 44 and platform 42 are being closed so that the lid retention bead 174 moves against, and slightly past, the platform undercut 120 owing to temporary elastic deformation of the lid 44 and/or platform 42. The engagement of the platform undercut 120 and lid retention bead 174 establish a latch closed position of the lid 44, and that prevents the lid 44 from thereafter being opened unless a sufficiently large lifting force is exerted on the lid 44 relative to the platform 42 (or vice versa) to effect temporary, elastic deformation sufficient to permit the lid retention bead 174 to move past, and outwardly beyond, the platform undercut 120.

As can be seen in FIGS. 25 and 28, the inside of the lid 44 includes a number of downwardly projecting ribs 175, and the ribs 175 are adapted to engage in the recesses or slots 160 around the periphery of the inner side cap (FIGS. 20 and 21) when the lid 44 is in the initially closed position over the initially installed inner side cap 46.

Figure 26:
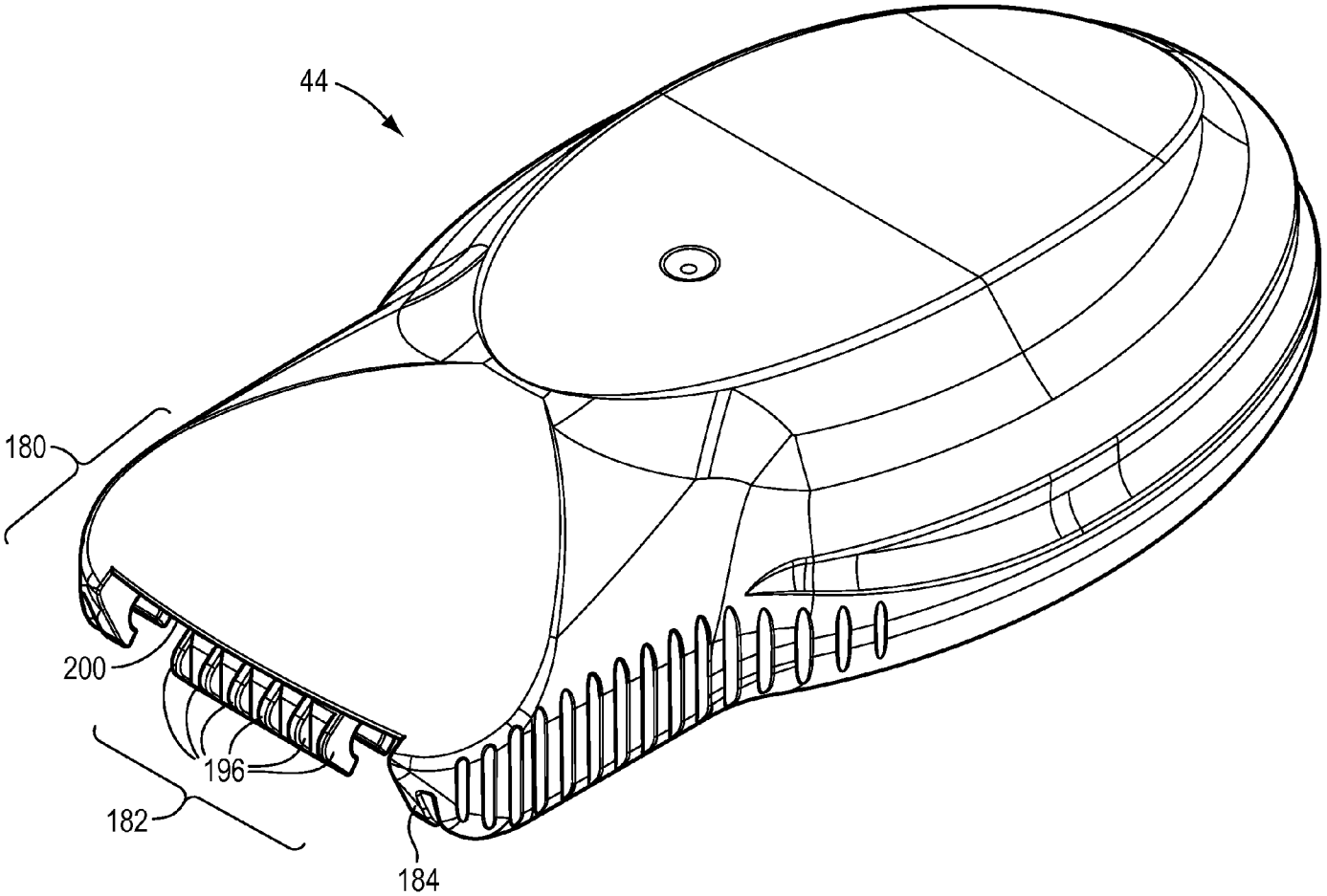
FIG. 26 is an isometric view of the lid, but in FIG. 26 the isometric view is taken from the top rear end of the lid looking toward the front end of the lid.

The rear end of the lid 44 defines a hinge portion designated generally by the bracket 180 in FIG. 26. As can be seen in FIG. 25, the hinge portion 180 includes a central receiving member 182 and two, laterally spaced-apart, outboard, receiving members 184. Each outboard receiving member 184 includes an opening 188 for each receiving one of the platform stub axles 96 (FIG. 14).

As can be seen in FIG. 25, the central receiving member 182 defines a central opening 190 for receiving the platform central axle 94 (FIG. 13). Each of the openings 188 of the two outboard receiving members 184, as well as the opening 190 of the receiving member 182, each have a reduced width at the distal ends of the receiving members, and the reduced width is less than the diameter of the associated platform central axle 94 and stub axles 96. The receiving members 182 and 184 are sufficiently resiliently flexible so as to accommodate insertion of the respective central axle or stub axle 94 and 96, respectively, in a snap fit engagement which accommodates rotation of the axles within the receiving members.

Figure 10:
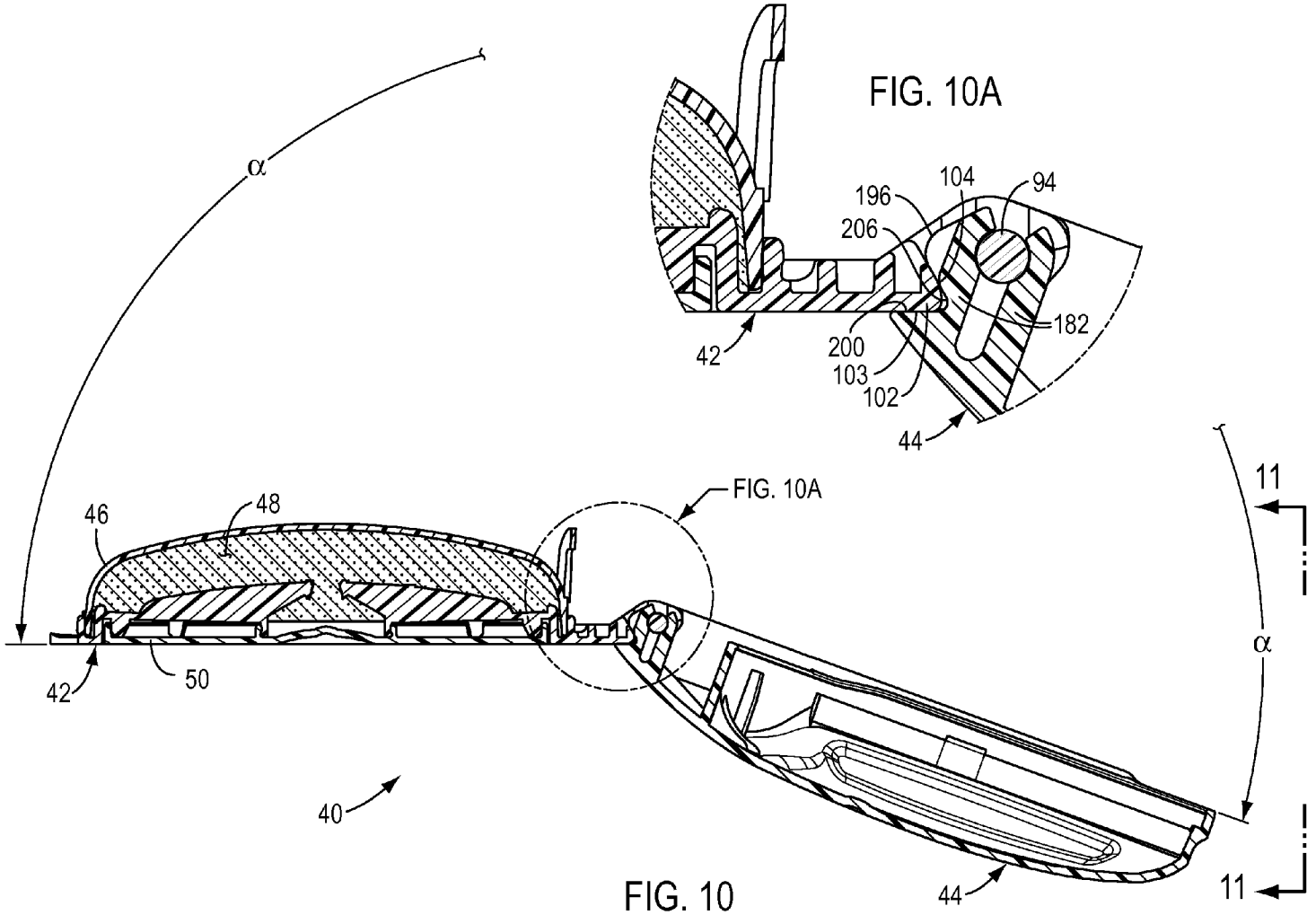
FIG. 10 is a cross-sectional view taken generally along the plane 10-10 in FIG. 2.
Figure 11:
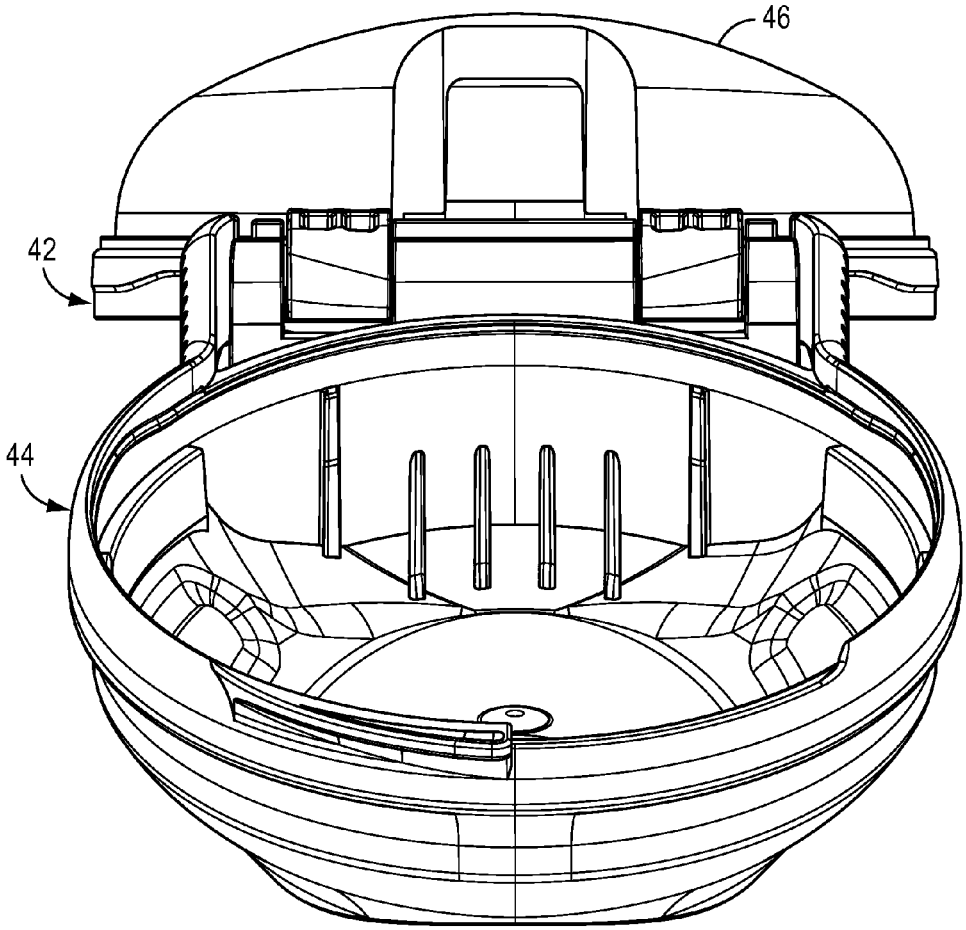
FIG. 11 is an end view taken generally along the plane 11-11 in FIG. 10.

As can be seen in FIG. 26, the rearwardly facing end of the central receiving member 182 defines a retention projection in the form of a plurality of spaced-apart arcuate ribs 196. Also, with reference to FIGS. 26, 28, and 29, the rear portion of the lid 44 defines a retention abutment surface 200 which extends outwardly over the tops of the retention projection ribs 196. This configuration defines a recess 206 (FIG. 28) between the tops of the retention projection ribs 196 and the facing retention abutment surface 200. The recess 206 is configured to receive the platform engaging member 102 when the lid 44 is in the open position (FIGS. 10 and 10A). When the lid 44 is in the open position (FIG. 10A), the engaging member 102 of the platform 42 is securely received and held in the recess 206 between the lid retention abutment surface 200 and the tops of the lid ribs 196.

The engagement between the surface 103 of the platform engaging member 102 and the lid retention abutment surface 200 prevents the lid 44 from being opened any further.

The lid 44 cannot be easily pivoted back to the closed position because the ribs 196 on the lid 44 engage the sloping end surface 104 of the platform engaging member 102 as can be seen in FIG. 10A. However, if a sufficient closing force is applied to the lid 44 to return it to the closed position (FIG. 8), then temporary, elastic deflection will occur in portions of the lid 44 and/or platform 42, and such temporary, elastic deflection will accommodate closing of the lid 44 by permitting the lid ribs 196 to move past the end of the platform engaging member 102.

Of course, when the lid 44 is pivoted with sufficient force from the closed position to the opened position, the ribs 196 on the lid 44 are carried past the end of the platform engaging member 102, owing to sufficient flexibility between the lid 44 and platform 42, until the engaging member 102 is received in the lid recess 206 (FIG. 10A).

The inventors have determined that for a user of an applicator package to apply an antiperspirant/deodorant, it is especially desirable for the full open, temporarily locked, condition of the lid 44 to be at an angle $\alpha$ (FIG. 10) relative to the platform 42 wherein the angle $\alpha$ is greater than about 120 degrees, and preferably is between about 150 degrees and about 250 degrees, and more preferably is between about 190 degrees and about 250 degrees. Of course, if the package 40 initially includes an inner side cap 46, then prior to applying the antiperspirant/deodorant (or any other substance 48) for the first time, the user would initially remove the inner side cap 46 (and may discard it, or may replace it after use, if desired).

Figure 5:
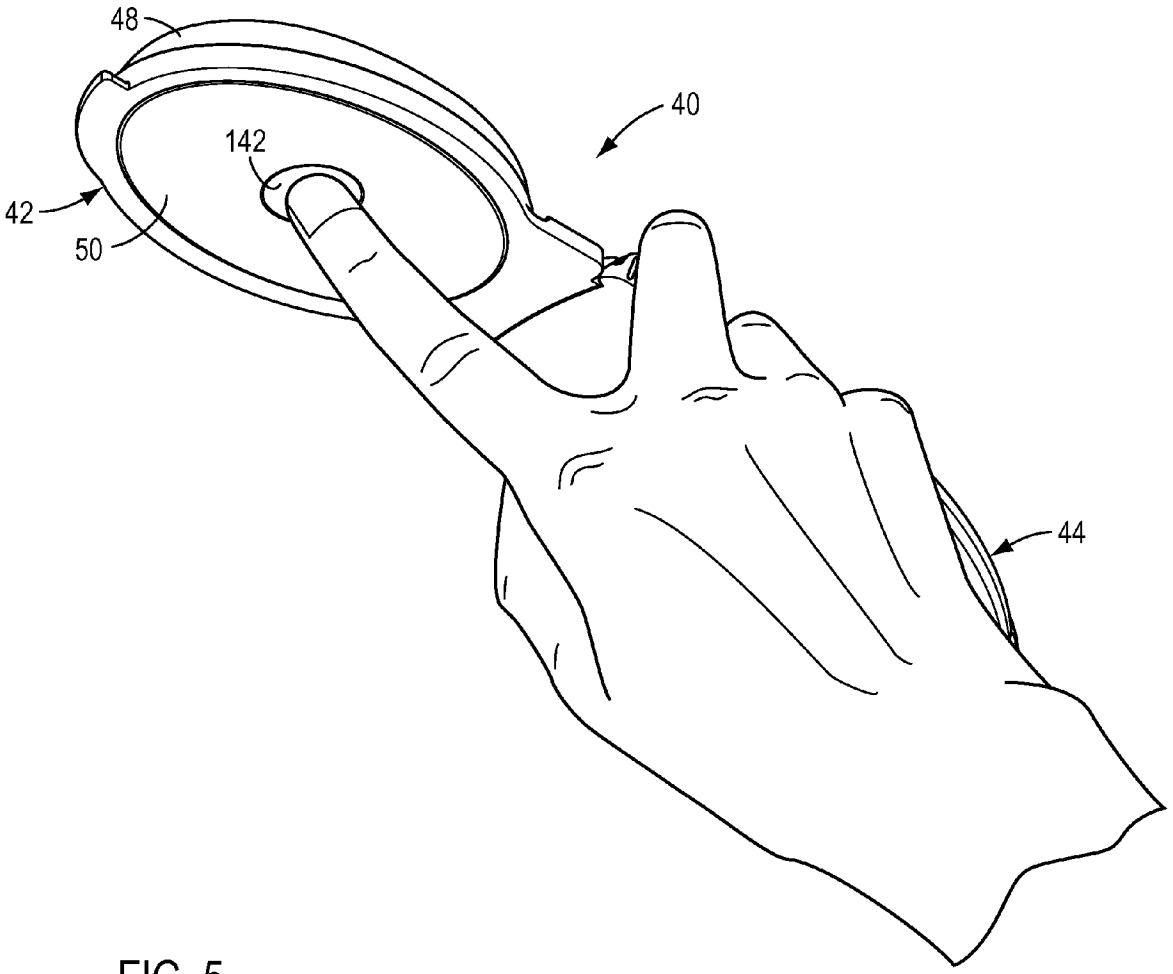
FIG. 5 is an isometric view similar to FIG. 4, but in FIG. 5 the opened applicator package is shown being held in the right hand of a user.
Figure 7:
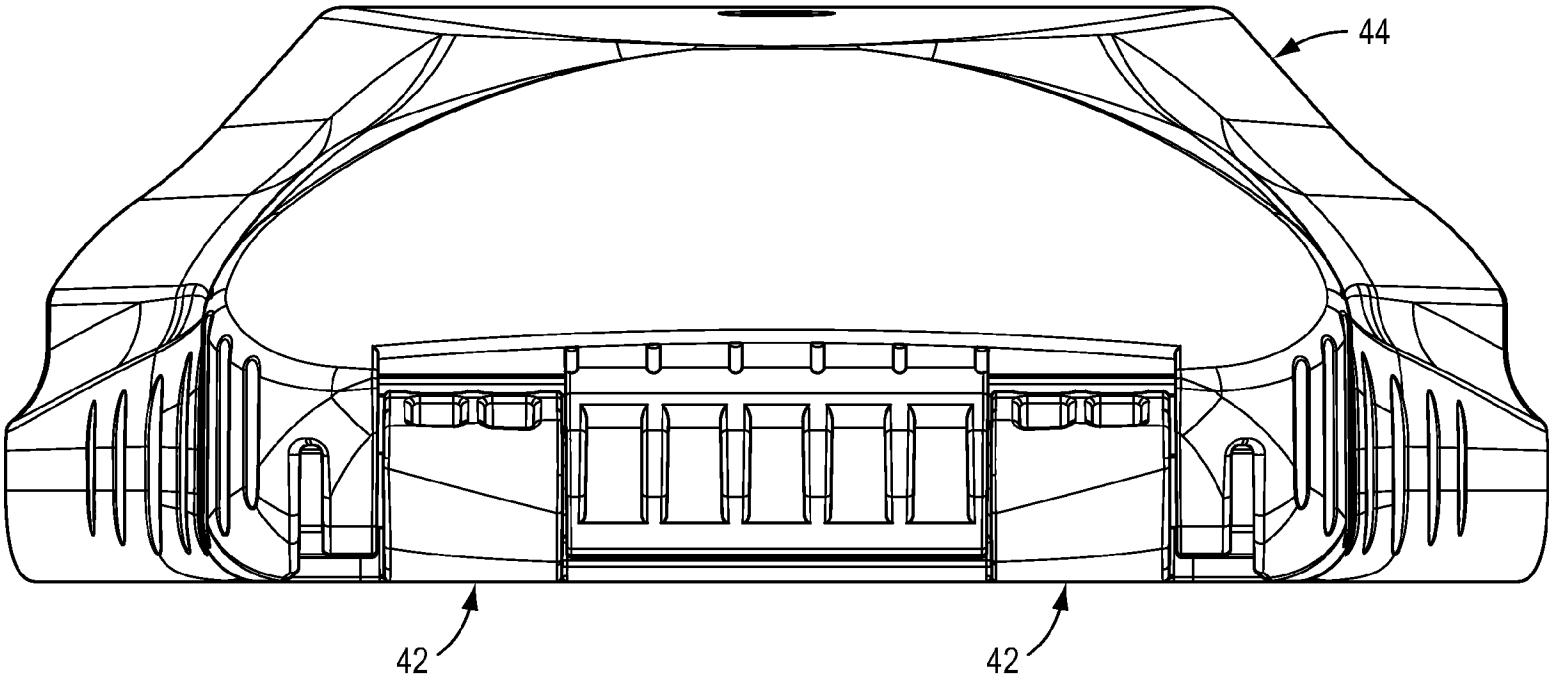
FIG. 7 is an end elevation view of the right hand end of the applicator package (where the right hand end of the applicator package is defined with reference to the orientation of the applicator package as shown in FIG. 6)
Figure 8:
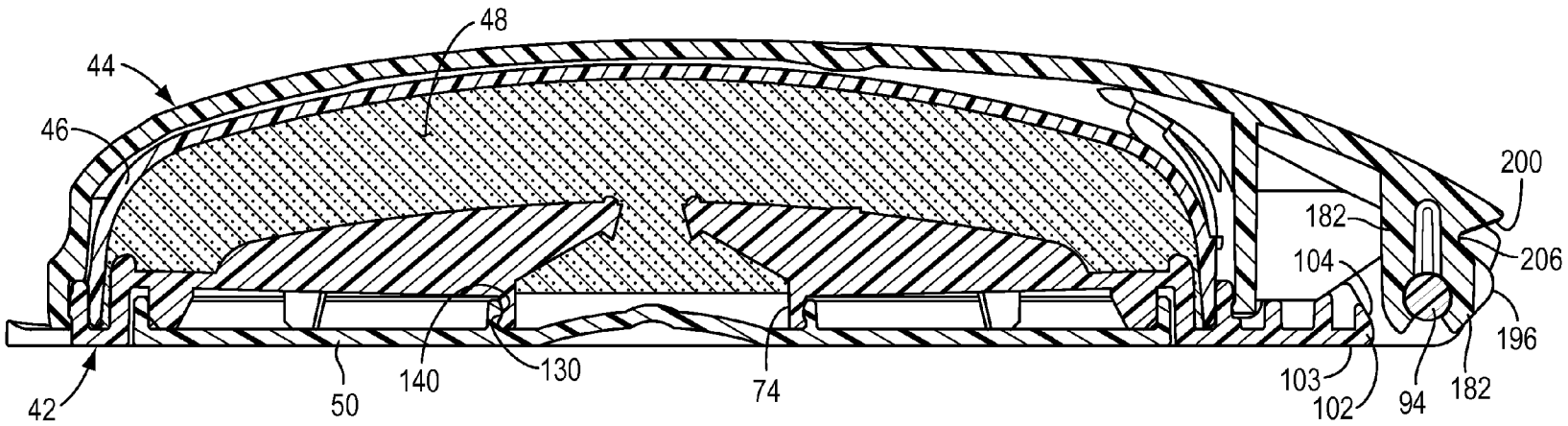
FIG. 8 is a cross-sectional view taken generally along the plane 8-8 in FIG. 1.

It has been found that such an angle $\alpha$ of the lid 44 (when the package is open) permits the user to readily grasp the lid 44 and use it as a handle as illustrated in FIG. 5. Also, such an angle of the lid 44 facilitates a user applying an antiperspirant/deodorant to the user's underarms in a comfortable manner. Such an angle of the lid 44 also readily accommodates the user holding the lid 44 as a handle and applying the antiperspirant/deodorant to an underarm of the user while the user is wearing a shirt or blouse. The use of the applicator under a person's garments can be effected in public because the angle of the lid 44 and the configuration of the applicator components permit the user to keep his or her hand (which is holding the applicator) and arm relatively close to the body under the garment during application. Thus, an antiperspirant/deodorant can be relatively discretely applied even while in public.

For use of the applicator package 40 by a user to apply an antiperspirant/deodorant, it has been found that the presently preferred angle of opening of the lid 44 relative to the platform 42 is about 200 degrees. The configuration of the applicator package, when the lid 44 is open, allows for convenient application of the product.

In the presently preferred embodiment of the lid 44 as illustrated in FIG. 4, the lid 44, at its hinge end, has a reduced width gripping region defined by oppositely facing, generally planar and parallel, lateral gripping surfaces 250 from which project a plurality of gripping ribs 252. The reduced width of the gripping region defined between the gripping surfaces 250 is designated as "RW" in FIG. 35, and is preferably between about 10 mm and about 60 mm, and in one proposed design is about 39 mm.

Figure 36:
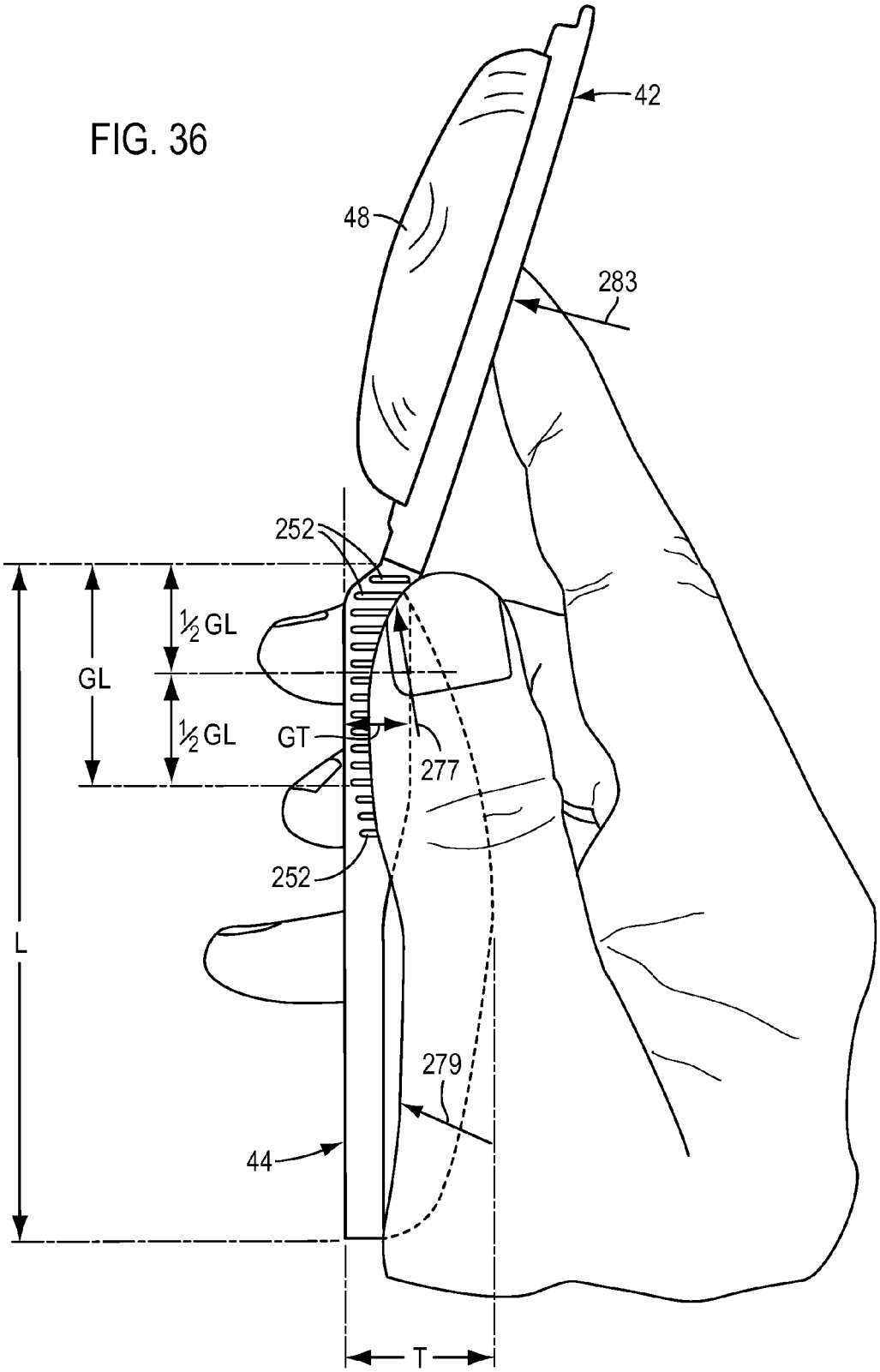
FIG. 36 is a simplified, diagrammatic side view of a user holding the opened package shown in FIG. 35.

The height of each planar, parallel portion of each lateral gripping surface 250 is designated as "GT" in FIG. 36, and is preferably between about 2 mm and about 20 mm, and in one proposed design the maximum height is about 10.5 mm.

The length of each planar, parallel portion of each lateral gripping surface 250, along the length of the lid 44, is designated as "GL" in FIG. 36, and is preferably greater than about 5 mm, and in one proposed design is about 24 mm.

Figure 35:
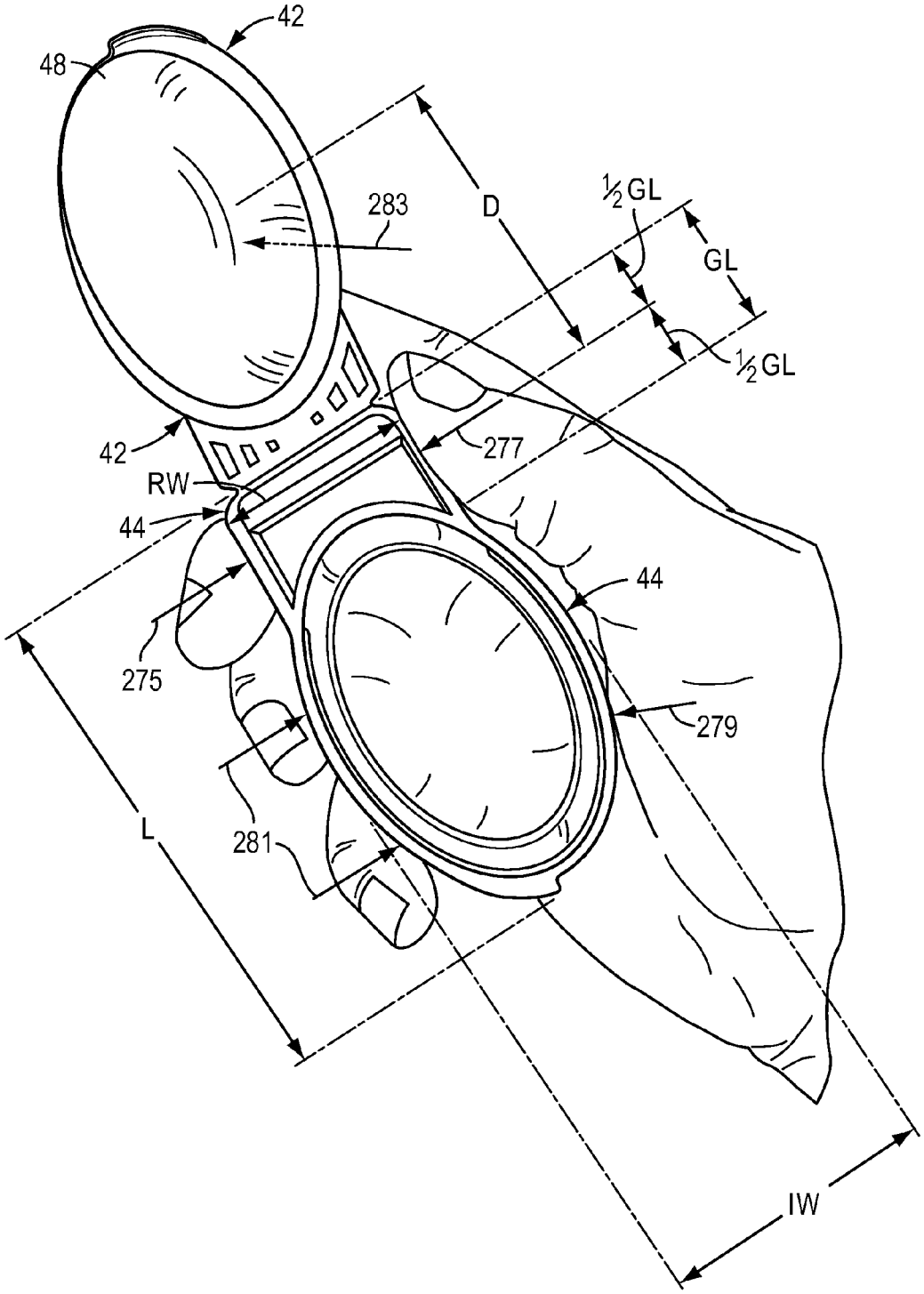
FIG. 35 is a simplified, diagrammatic, isometric view of the opened package held by a user after removal of the inner side cap.

The lid 44 also has an increased width region 260 (FIG. 4) which has a maximum width that is designated "IW" in FIG. 35, and is preferably between about 25 mm and about 70 mm, and in one proposed design is about 50 mm. As can be seen for the preferred embodiment in FIGS. 4 and 36, the gripping ribs 252 also are provided beyond the planar, parallel portion of each lateral gripping surface 250 so that some shorter ribs 252 are located along the side of the increased width region 260.

The overall maximum height of the increased width region 260 (from the lid interior side to the lid exterior side) is designated as "T" in FIG. 36, and is preferably between about 15 mm and about 25 mm, and in one proposed design is about 19 mm.

When the lid 44 is open (FIGS. 4, 35, and 36), the distance "D" (FIG. 35) between the center of the recessed region 142 and the midpoint of the length of each planar, parallel portion of each lateral gripping surface 250 is preferably between about 25 mm and about 90 mm, and in one proposed design is about 60 mm.

A presently preferred overall length of the lid 44 is designated as "L" in FIG. 35, and is between about 60 mm and about 100 mm, and in one proposed design is about 67 mm.

According to one broad aspect of the invention, the lid 44 functions as a handle, and in the illustrated embodiment, the lid 44 is hingedly (i.e., pivotably) attached to the platform 42 so that use of the attached lid 44 as a handle substantially minimizes fumbling and/or prevents or minimizes the likelihood of loss of components.

In the illustrated preferred embodiment, the lid 44 provides a secure closure and accommodates an easy reclosing motion.

In the illustrated preferred embodiment, the product can be more easily applied in a comfortable, uniform, and efficacious manner. Further, because the product can be completely contained on the platform 42 under the lid 44 when the lid is closed, the applicator package can be kept relatively clean with little or no mess.

The preferred embodiment package 40 does not have a product advancing mechanism, so there is no need to manipulate or "activate" the package from time-to-time in a way that would expose more of the product for application.

Because the antiperspirant/deodorant (or other substance to be applied) can be provided with a substantially uniform thickness, and with a substantially wide and long exposed surface, the user may find it more comfortable and easier to apply the antiperspirant/deodorant (or other substance) in a more uniform manner and more quickly—with less residual product remaining inaccessible in the package—compared to conventional stick type applicators of antiperspirant/deodorant.

The configuration of the components of the present invention accommodates assembly as an applicator package of a convenient, small size which can be carried in a pocket or a purse. The preferred form of the package 40 illustrated in FIG. 1 is especially suitable for holding a small quantity of product (i.e., substance 48) on the order of about 15-30 ml (½-1 fluid ounce). In one presently preferred size of the package 40 having the configuration illustrated in FIGS. 1-11, the package 40, when closed, has a maximum length of not more than about 100 mm (preferably about 67 mm), a maximum width of not more than about 70 mm (preferably about 50 mm), and a maximum height of not more than about 25 mm (preferably about 19 mm). The exterior configuration of the package 40 can be smooth and sleek while also being sufficiently robust to accommodate the user carrying the package all day in the user's pocket or purse.

In the illustrated preferred embodiment, the lid 44 can be easily and comfortably grasped and held in the hand by a user as can be seen in FIGS. 35 and 36. With reference to FIG. 35, the user's second finger can engage the lid (handle) 44 on one lateral side or edge indicated by the arrow 275, and the thumb can engage the other side of the lid as indicated by the arrow 277. Preferably, as can be seen in FIG. 36, the thumb and the second finger engage the gripping surfaces 250 (containing the ribs 252) on opposite sides of the reduced width gripping region RW. As can be seen in FIG. 36, the user's palm and the inside of the base of the user's thumb can engage and cradle the increased width region IW along the exterior side of the lid (handle) 44 as indicated by the arrow 279. As can be seen in FIG. 35, the user's third and fourth fingers can engage the edge of the lid (handle) 44 along the increased width region IW as indicated by the arrows 281.

It has been found that the user can advantageously apply the antiperspirant/deodorant (or other substance) 48 by extending the person's index finger along the platform outer side and pushing on the bottom (i.e., outer side or back) of the platform (as indicated by arrow 283 in FIGS. 35 and 36)—most preferably by pushing on the slightly concave recessed area 142 defined in the bottom cover 50 (FIG. 5) which is mounted to the bottom of the platform 42 in the illustrated, preferred embodiment. This method of using the applicator package, as illustrated in FIGS. 5, 35, and 36, enables the user to comfortably provide a desired amount of force as may be necessary or desired for the application of the particular substance 48. Also, the use of the index finger to engage the recess region 142 allows the user to more effectively control the movement of the applicator package 40, especially if it is desired to contact a target region with the surface of the substance 48 while the user effects, for example, a longitudinally reciprocating motion, a circular motion, a laterally reciprocating motion, etc.

The inventive applicator package 40 can be produced according to a novel method that provides the various advantages and benefits. For the preferred embodiment of the applicator package 40 illustrated in FIGS. 1-29, a manufacturer would preferably initially produce the separate components of the bottom cover 50, platform 42, inner side cover 46, and lid 44. These four components can be readily manufactured by molding them from suitable thermoplastic materials, for example.

After the platform 42, bottom cover 50, inner side cap 46, and lid 44 are molded or otherwise produced, the inner side cap 46 is mounted on the top of the platform 42 to define a cavity between the platform 42 and the inside of the inner side cap 46.

Next the lid 44 is connected to the platform 42 by snap-fitting together the inter-fitting hinge portions of the platform 42 and lid 44. In a preferred method, the lid 44 and platform 42 are snapped into engagement at the hinge portions while the lid 44 and platform 42 are in an open orientation, and then the lid 44 is pivoted to the closed position on top of the platform 42 so that the platform undercut 120 engages or latches with the lid retention bead 174.

The assembly of the platform 42, inner side cap 46, and closed lid 44 is then provided, along with the loose (uninstalled) bottom cover 50, to a "filler" which is typically another manufacturing entity that will provide the substance (product) 48 to be filled (loaded) into and onto the platform 42, including in the cavity underneath the inner side cap 46. When the cavity and platform have been filled with the substance 48, then the bottom cover 50 is installed by the filler onto the bottom of the platform 42.

Further, according to a broad aspect of the method, a bottom cover, such as the bottom cover 50, need not be provided—depending upon the type of substance that is being filled into the platform 42 and depending upon the particular way in which it is intended for the user to apply the substance.

Figure 30:
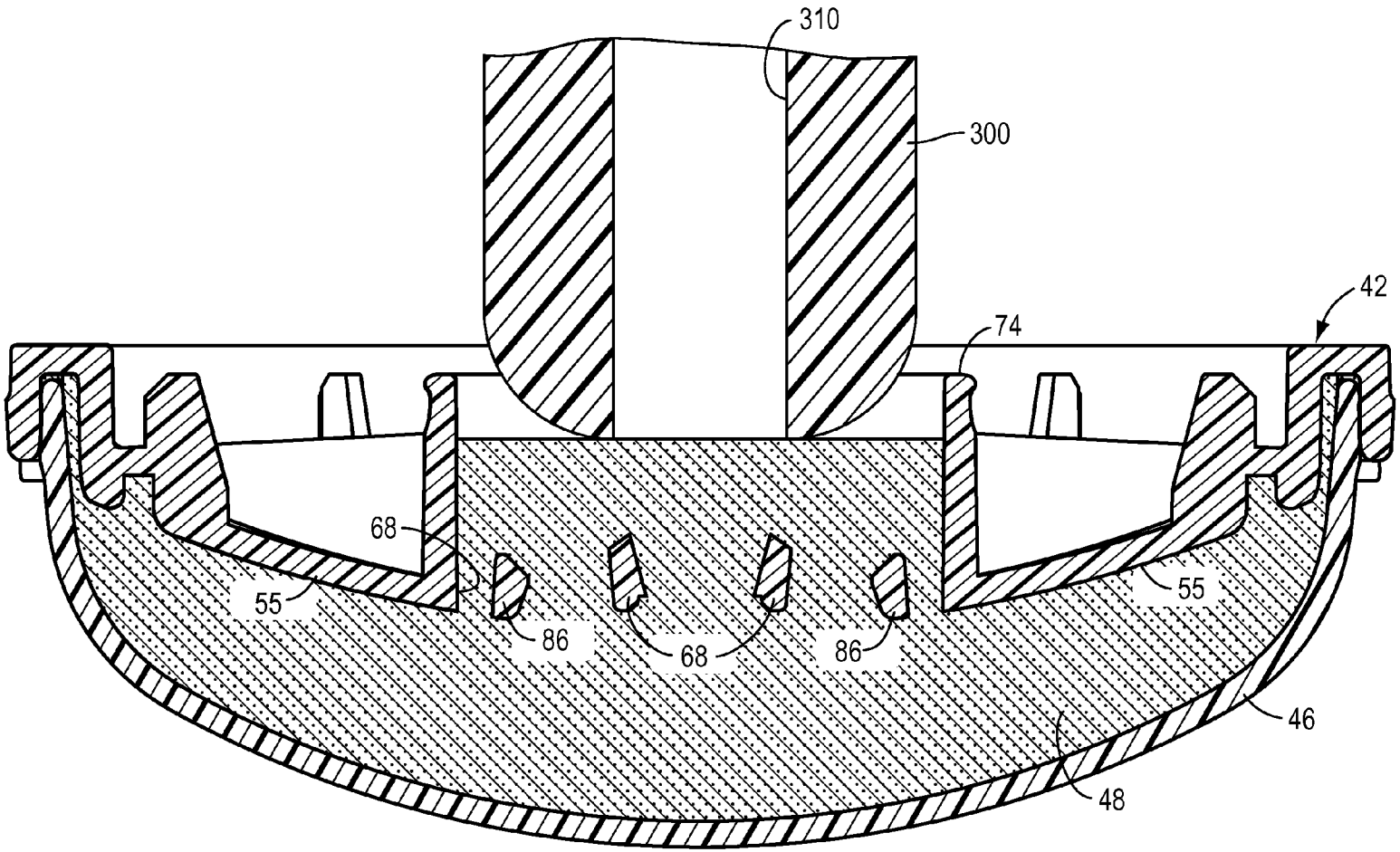
FIG. 30 is a partially diagrammatic, cross-sectional view similar to FIG. 16, but FIG. 30 shows the platform of FIG. 16 inverted and assembled with the releasable, inner side cap, and with a filling head (e.g., fill nozzle) located in position over the platform after completing filling of the platform with a substance.
Figure 31:
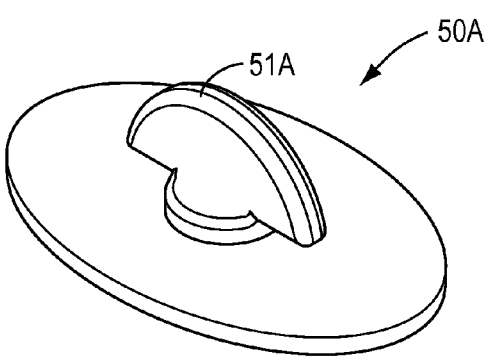
FIG. 31 is an isometric view of a first alternate embodiment of only the plug plate wherein the plug plate includes an integral handle, and in FIG. 31 the isometric view is taken looking toward the exterior of the plug plate prior to installation of the plug plate on the bottom of the platform (not illustrated)
Figure 32:
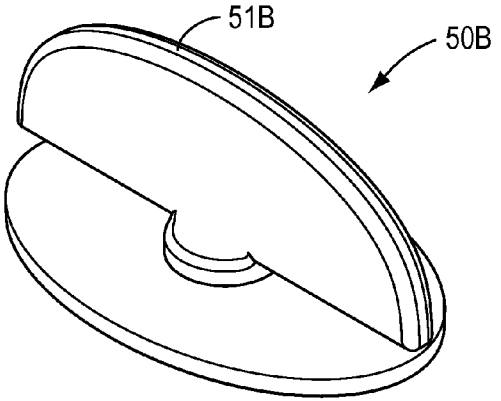
FIG. 32 is an isometric view of a second alternate embodiment of only the plug plate wherein the plug plate includes an integral handle, and in FIG. 32 the isometric view is taken looking toward the exterior of the plug plate prior to installation of the plug plate on the bottom of the platform (not illustrated).
Figure 33:
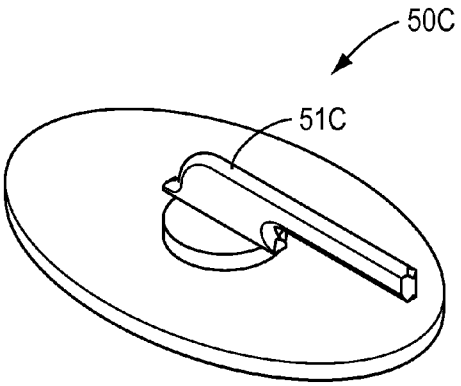
FIG. 33 is an isometric view of a third alternate embodiment of only the plug plate wherein the plug plate includes an integral handle, and in FIG. 33 the isometric view is taken looking toward the exterior of the plug plate prior to installation of the plug plate on the bottom of the platform (not illustrated)
Figure 34:
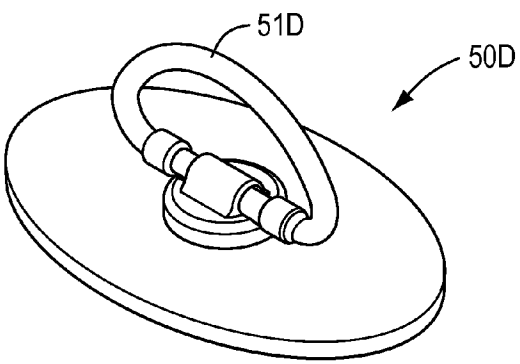
FIG. 34 is an isometric view of a fourth alternate embodiment of only the plug plate wherein the plug plate includes an integral handle, and in FIG. 34 the isometric view is taken looking toward the exterior of the plug plate prior to installation of the plug plate on the bottom of the platform (not illustrated)

According to one aspect of the method of making and filling the package 40, the present invention, the platform can be filled with a substance 48 in a novel manner that has benefits and advantages. FIG. 30 shows how the platform 42 is filled with a substance while the platform 42 is inverted (i.e., inverted with respect to the position of the platform 42 as generally shown in the FIGS. 1-16). As illustrated in FIG. 30, the inner side cap 46 is mounted on the inverted platform 42 to define a cavity for receiving the substance 48 which is discharged from a fill nozzle 300. In FIG. 30, the lid is not shown for purposes of clarity. The lid 44 would typically be closed around the inner side cap 50 prior to and during the filling process.

The distal end of the fill nozzle 300 is disposed to project somewhat inwardly from the distal end of the upwardly facing distal end of the "fill chimney" or containment wall 74. The fill nozzle 300 is centered over the central fill passage defined by the conduit 68. In FIG. 30, the substance 48 obscures the background portion of the conduit 68 and other background features. However, it is to be realized that the cross-section of the platform 42 in FIG. 30 is the same as the cross-section of the platform 42 shown in FIG. 16 except that in FIG. 30 the platform 42 is inverted and some of the background features are not visible owing to the presence of the substance 48.

With continued reference to FIG. 30, it is seen that the fill nozzle 300 has an internal fill bore 310 which has about the same diameter as the diameter of the conduit 68 in the platform 42. When the substance 48 is discharged from the fill nozzle 300 through the bore 310, the stream of the substance 48 enters into the platform primarily through the conduit 68 and flows to the inner side support surface 55 of the platform 42.

With particular reference to FIGS. 13 and 16, the incoming flow of the substance 48 enters the area adjacent the platform substance support surface 55. As can be seen in FIG. 30, the substance is contained within the cavity defined in part by the inner side cap 46. The incoming substance 48 is deflected laterally by the cap 46 and flows throughout the cavity, including into the channels 60 (see FIGS. 12 and 14).

As the substance 48 flows from the fill nozzle 300 through the platform conduit 68 and into the cavity between the platform support surface 55 and the inner side cap 46, the air within the cavity is vented out through inner open ends of the channels 60 inwardly toward the central conduit 68. The venting air flows through the spaces around the periphery of the conduit 68 (see FIGS. 12, 14 and 16), and the venting air continues to flow outwardly toward the outer side of the platform 42 in the generally annular region defined between the conduit 68 and the containment wall 74 (see FIG. 16).

Some of the venting air can also flow through the apertures 80 in the inner end projections 86 of the support surface 55, and from there toward the platform outer side in the generally annular space between the containment wall 74 and the central fill passage conduit 68.

Additionally, air is vented through the openings between platform projections 86 and the central periphery of the fill passage conduit 68.

The venting of the air from the inner side of the platform 42 covered by the inner side cap 46 facilitates a rapid, effective, and complete filling of the cavity with the substance 48, and this minimizes, if not eliminates, the likelihood of the formation of unwanted voids or cavitation.

In a preferred method of filling the cavity with the substance 48, the filling process is continued until the substance 48 flows completely into, and inwardly beyond, the channels 60 (see FIGS. 12 and 14) so that the substance 48 flows into the region between the outer containment wall 74 and central fill conduit 68. As some of the substance 48 forces (and follows) the venting air to the platform outer side 56, some of the substance 48 also flows past the projections 86 and also through the apertures 80 in the projections 86 (see FIGS. 12, 14, and 16) to help fill the region within the containment wall 74.

With reference to FIG. 30, the flow of the substance 48 from the fill nozzle 300 is terminated after a sufficient amount of the substance 48 has been discharged into the platform 42 so that a significant portion of the interior volume within the containment wall 74 is filled with the substance 48 and so that some of the substance 48 is on the outer portions of the fill conduit 68 and on the outer side of the overhanging end projections 86. In particular, by comparing FIGS. 16 and 30, it can be seen that the substance 48 extends on the outer side of the overhanging portions or end projections 86 of the support surface 55 as well as the outer end of the fill conduit 68.

As can be seen in FIG. 30, when the substance 48 becomes sufficiently solidified or otherwise dimensionally stable, the substance 48 is securely held in place by the contact between the substance 48 and inside surface of the containment wall 74, and, significantly, by the various embedded portions of the platform structure, including the end projections 86 and the central fill conduit 68, as well as extending portions of the ribs 70 (the ribs 70 not being visible in FIG. 30, but being visible in FIG. 16).

The novel method of filling the platform 42 with the substance 48 facilitates venting of air during the filling process and prevents, or at least greatly minimizes, the formation of unwanted voids. The process can also minimize cavitation and results in a secure attachment, or adhesion, of the substance 48 to the platform 42. Further, owing to the relatively small central volume within the containment wall 74 that is filled with the substance 48, and owing to the relatively narrow (and small volume) channels 60 that are filled with the substance 48, the amount of the substance 48 within the channels 60 and within the containment wall 74 is not an undesirable large amount that remains unusable during the process of applying the substance 48 to a target region. Thus, a large portion of the substance 48 on the platform 42 is available to be applied by the user.

After the platform 42 has been filled with the substance 48, the nozzle 300 is removed, and the bottom cover 50 (FIGS. 6, 8, 17, 18 and 19) is press-fit onto the bottom of the platform 42 as previously described. The bottom cover 50 provides an aesthetically pleasing exterior configuration. Further, the bottom cover 50 can minimize ingress of the dirt and other contaminants into the underside of the platform 42. The bottom cover 50 can also function to prevent contact between the user and a portion of the substance 48 that extends into the interior of the containment wall 74 on the platform outer side 56.

In an alternate embodiment not illustrated, the inner fill cap 46 may be omitted altogether. The lid 44, instead of the inner side cap 46, is then used as a dome to define the cavity into which the substance 48 is injected onto the platform 42 pursuant to the package filling method discussed above.

Alternate embodiments of the bottom cover 50 are illustrated in FIGS. 31, 32, 33 and 34 wherein the alternate forms of the bottom cover are designated by the reference numbers 50A, 50B, 50C and 50D, respectively. Each alternate embodiment of the bottom cover 50A, 50B, 50C and 50D has an interior configuration identical or generally similar to that of the first embodiment bottom cover 50 illustrated in FIGS. 17-19. Further, each of the alternate embodiment forms of the bottom cover 50A, 50B, 50C and 50D has substantially the same mounting configuration features as the first embodiment bottom cover 50. In particular, with reference to FIG. 18, the first embodiment of the bottom cover 50 has a peripheral flange 134 and an interior mounting flange 138 for securing the bottom cover 50 to the platform as previously described, and those same features may be provided on the interior side of each of the alternate embodiment bottom covers 50A, 50B, 50C and 50D.

The alternate bottom covers 50A, 50B, 50C and 50D each include a different shape or type of "auxiliary" or "helper" handle 51A, 51B, 51C and 51D, respectively, projecting from the outside or exterior side. The handles may be grasped by a user to assist in applying the substance to a target region. If an alternate embodiment bottom cover with a handle 51A, 51B, 51C, or 51D is employed, the lid 44 is still provided for use as a handle (in conjunction with the helper handle 51A, 51B, 51C, and 512D, or exclusively, if desired, instead of the helper handle 51A, 51B, 51C, or 51D).

Further, the present invention contemplates that other shapes and configurations of a helper handle on a bottom cover 50A-50D could be provided.

The invention contemplates that in an alternate embodiment (not illustrated) the lid hinge portions 182, 184 could be provided on the platform 42, and the platform hinge portions 94, 96 could be provided on the lid 44.

The invention also contemplates that in an alternate embodiment (not illustrated) the lid cooperating features 196, 200, and 206 (which establish the predetermined open orientation) could be provided on the platform 42, and the platform cooperating feature 102 could be provided on the lid 44.

One aspect of the present invention contemplates that the invention can be provided as a set of unassembled components for being assembled as an applicator of a substance that a user can apply to a target region. Such a set of components would include at least the platform (such as the platform 42) and lid 44. The invention further contemplates that in a preferred form of the set of components to be provided, the set of components would preferably also include the inner side cap 46 and/or bottom cover 50.

A broad aspect of the invention contemplates that the lid 44 could be provided as a component that is releasably attachable in the closed position to the platform 42 for subsequent complete removal by the user. Another broad aspect of the invention further contemplates that the lid could be initially provided as a separate component that the user (not the manufacturer) could hingedly attach to one end of the platform 42, if desired. After such attachment of the lid by the user, the user may move the lid between the open position and the closed position, and vice versa. As discussed above, another broad aspect of the invention contemplates the inner side cap 46 may be omitted altogether.

The invention also broadly contemplates that the platform 42 can be designed to accommodate a variety of substances, including liquids, which can be advantageously applied using the lid as a handle in accordance with the teachings of the invention.

The illustrated preferred embodiment of the applicator package 40 described herein, as well as alternate embodiments and alternate forms of the applicator package as described herein, can be implemented in a size and configuration that accommodates ease of handling, ease of carrying, and ease of use, as well as other advantages and benefits as previously described.

Many, but not necessarily all, of the various combinations of features of the present invention can be summarized in the following numbered statements or aspects.

1. A set of components for being assembled as an applicator for use as a package containing a substance that a user can apply to a target region, said set of components comprising:

a platform having an outer side and having an inner side defining a substance support surface for supporting a substance to be applied to a target region by a user; and a lid that can be selectively located relative to said platform at (1) a closed position covering a substance on said platform, and (2) a predetermined open position in which said lid is attached to said platform in a way that would expose a substance on said platform, at least a portion of said lid having a configuration for being grasped and used as a handle by a user when said lid is attached in said predetermined open position to said platform so the user can effect movement of said platform to apply the substance by contacting a target region with a portion of the exposed substance; and wherein one of said lid and said platform defines an engaging member, and the other of said lid and said platform defines (1) a retention abutment surface, and (2) a retention projection that is adjacent, but spaced from, said retention abutment surface to define a recess between said retention abutment surface and said retention projection; and one of said lid and said platform includes an axle defining a pivot axis, and the other of said lid and said platform includes a receiving member for receiving said axle in a snap-fit engagement to accommodate relative rotation between said lid and said platform about said pivot axis to move said engaging member against and past said retention projection wherein such movement is accommodated by temporary elastic deformation of at least a portion of at least one of said lid and said platform so as to locate and releasably retain said engaging member in said recess between said retention abutment surface and said retention projection when said lid is in said open position.

2. The set of components in accordance with aspect 1 in which said lid and said platform are initially separately molded and can be subsequently attached together by effecting said snap-fit engagement of said receiving member and said axle;

said lid and said platform are configured to permit said lid to be releasably latched to said platform over said platform inner side when said components are assembled and said lid is in said closed position; and said lid and said platform when assembled together can establish said open position at an orientation wherein said lid is between about 150 degrees and about 250 degrees from said closed position.

3. The set of components in accordance with any of the preceding aspects 1-2 in which said axle is defined by said platform;

said axle receiving member is defined by said lid;

said engaging member is defined by said platform;

said retention abutment surface is defined by said lid; and said retention projection is an arcuate rib defined on said lid.

4. An applicator for use as a package containing a substance that a user can apply to a target region, said applicator comprising:

a platform having an outer side and having an inner side defining a substance support surface for supporting a substance to be applied to a target region by a user; and a lid that can be selectively located at (1) a closed position covering a substance on said platform, and (2) an open position in which said lid and said platform are connected in a way that exposes a substance on said platform, and wherein said lid and said platform each has cooperating features that establish said lid in said open position at an orientation that is at least about 150 degrees from said closed position, and wherein at least a portion of said lid has a configuration for being grasped and used as a handle by a user when said lid is in said open position so the user can effect movement of said platform to apply the substance by contacting a target region with a portion of the exposed substance.

5. The applicator in accordance with aspect 4 further including a substance supported on said platform substance support surface wherein said applicator and said substance together define a package.

6. The applicator in accordance with any of the preceding aspects 4-5 in which said lid and said platform are initially separately molded, and each said lid and platform includes a hinge portion cooperating to establish a snap-fit engagement of said hinge portions to define a hinge accommodating opening and closing of said lid about a pivot axis relative to said platform;

said cooperating engagement features of said lid and platform establish said open position at an orientation that is between about 150 degrees and about 250 degrees from said closed position; and said lid and said platform are configured to permit said lid to be releasably latched to said platform over said platform inner side when said lid is in said closed position.

7. The applicator in accordance with any of the preceding aspects 4-6 in which one of said platform and said lid defines an engaging member and the other of said platform and said lid defines (1) a retention abutment surface, and (2) a retention projection that is adjacent, but spaced from, said retention abutment surface to define a recess between said retention abutment surface and said retention projection for receiving and releasably retaining said engaging member when said lid is in said open position to releasably maintain said lid in said open position when said lid is held by a user to apply the substance.

8. The applicator in accordance with any of the preceding aspects 4-7 in which said retention projection is defined by at least one arcuate rib on said lid.

9. An applicator package containing a substance that a user can apply to a target region, said applicator package comprising:

a platform having an outer side and an inner side, a substance on said platform inner side, and a lid having an exterior side and an interior side wherein a portion of each said platform and said lid together define a hinged connection accommodating movement of said lid between a closed position covering said substance and an open position exposing said substance; and said lid has (1) a distal end opposite said hinged connection, (2) a reduced width gripping region adjacent said hinged connection, (3) an increased width region between said distal end and said reduced width gripping region, and (4) a convex configuration on said exterior side of said lid at said increased width region whereby a user can hold said package in one hand when said lid is in said open position so that said lid can function as a handle wherein (a) said lid convex configuration can be located in the palm of the user's hand, (b) said reduced width gripping region can be gripped between the thumb and at least one finger of the user's hand, and (c) said outer side of said platform can be subjected to a pressing force imposed by the index finger of the user's hand.

10. The applicator package in accordance with aspect 9 in which said reduced width gripping region (1) is defined at least in part by a pair of generally planar parallel lateral gripping surfaces, (2) has a width of between about 10 mm and about 60 mm; and (3) has a height of less than about 20 mm; and said increased width region has maximum width of between about 25 mm and about 70 mm.

11. The applicator package in accordance with any of the aspects 9-10 in which (1) the maximum height of said increased width region of said lid from said exterior side to said interior side is between about 15 mm and about 25 mm; and (2) the maximum length of said lid is between about 60 mm and about 100 mm.

12. The applicator package in accordance with any of the aspects 9-11 in which said platform outer side has circular concave recess for receiving the end of the user's index finger; and the distance between a midpoint of the length of said reduced width gripping region and the center of said recess is between about 25 mm and about 90 mm when said lid is in said open position.

13. The applicator package in accordance with any of the aspects 10-12 in which said planar parallel lateral gripping surfaces each has a length of about 24 mm.

14. A method of applying a substance to a target region, said method comprising the following steps:

I. providing a platform having an outer side and having an inner side defining a substance support surface on which a substance is supported;

II. providing a lid that can be selectively located at (1) a closed position covering a substance on said platform, and (2) an open position in which said lid and said platform are connected in a way that exposes a substance on said platform, wherein said lid and platform each has cooperating features that establish said lid in said open position at an orientation that is at least about 150 degrees from said closed position, and wherein at least a portion of said lid has a configuration for being grasped and used as a handle by a user when said lid is in said open position;

III. moving said lid from said closed position to said open position to expose said substance;

IV. grasping said lid with one hand to hold said lid while it is in said open position; and V. moving said open lid to effect movement of said platform to apply the substance by contacting a target region with a portion of the exposed substance.

15. The method in accordance with aspect 14 in which steps I and II include providing said lid and said platform configured to permit said lid to be releasably latched to said platform over said platform inner side when said lid is in said closed position; and step III includes unlatching said lid.

16. The method in accordance with any of the preceding aspects 14-15 in which step V includes holding said lid with one hand while extending a finger of that hand alongside said platform outer side and exerting a force with said finger on said platform outer side in a direction to urge said substance against said target region.

17. The method in accordance with aspect 16 in which step I includes providing a bottom cover attached to said platform outer side; and step IV includes pressing said finger against said bottom cover.

18. The method in accordance with any of the preceding aspects 14-17 in which step III includes pivoting said lid to said open position wherein the orientation of said lid is greater than about 150 degrees from said closed position.

19. The method in accordance with any of the preceding aspects 14-17 in which step III includes pivoting said lid to said open position wherein said lid has a self-maintained, but releasable, orientation that is between about 150 degrees and about 250 degrees from said closed position.

What is claimed is:

1. A method of applying a substance to a target region, said method comprising the following steps:

I. providing a platform (42) having an outer side (56) and having an inner side (54) defining a substance support surface (55) on which a substance (48) is supported;

II. providing a lid (44) that can be selectively located at (1) a closed position covering a substance (48) on said platform (42), and (2) an open position in which said lid (44) and said platform (42) are connected in a way that exposes said substance (48) on said platform (42), wherein said lid (44) and platform (42) each has cooperating features that establish said lid (44) in said open position at an orientation that is at least about 150 degrees from said closed position, and wherein at least a portion of said lid (44) has a configuration for being grasped and used as a handle (44) by a user when said lid (44) is in said open position;

III. moving said lid (44) from said closed position to said open position to expose said substance (48);

IV. grasping said lid (44) with one hand to hold said lid (44) while it is in said open position; and V. moving said open lid (44) to effect movement of said platform (42) to apply the substance (48) by contacting a target region with a portion of the exposed substance (48), said step V including holding said lid (44) with one hand while extending a finger of that hand alongside said platform outer side (56) and exerting a force with said finger on said platform outer side (56) in a direction to urge said substance (48) against said target region.

2. The method in accordance with claim 1 in which step I includes providing a bottom cover (50) attached to said platform outer side (56); and step IV includes pressing said finger against said bottom cover (50).

* * * * *